US011384992B2

(12) United States Patent
Suzuki et al.

(10) Patent No.: US 11,384,992 B2
(45) Date of Patent: Jul. 12, 2022

(54) HEAT EXCHANGER

(71) Applicant: WELCON Inc., Niigata (JP)

(72) Inventors: Yutaka Suzuki, Niigata (JP); Takashi Saito, Niigata (JP); Hiroaki Kimura, Niigata (JP); Shingo Ikarashi, Niigata (JP)

(73) Assignee: WELCON Inc., Niigata (JP)

( * ) Notice: Subject to any disclaimer, the term of this patent is extended or adjusted under 35 U.S.C. 154(b) by 19 days.

(21) Appl. No.: 16/642,118

(22) PCT Filed: Aug. 29, 2017

(86) PCT No.: PCT/JP2017/031030
§ 371 (c)(1),
(2) Date: Feb. 26, 2020

(87) PCT Pub. No.: WO2019/043802
PCT Pub. Date: Mar. 7, 2019

(65) Prior Publication Data

US 2020/0182551 A1 Jun. 11, 2020

(51) Int. Cl.

| | |
|---|---|
| ***F28F 3/00*** | (2006.01) |
| ***F28D 9/00*** | (2006.01) |
| ***F28F 13/12*** | (2006.01) |

(52) U.S. Cl.
CPC ..... *F28D 9/00* (2013.01); *F28F 3/00* (2013.01); *F28F 13/12* (2013.01)

(58) Field of Classification Search
CPC ..... F28D 9/0056; F28D 9/005; F28D 9/0093; F28F 3/008; F28F 13/12
See application file for complete search history.

(56) References Cited

U.S. PATENT DOCUMENTS 4,665,975 A 5/1987 Johnston
5,544,703 A * 8/1996 Joel ..... F28F 3/048 165/167

(Continued)

FOREIGN PATENT DOCUMENTS

CN 103225974 A 7/2013
CN 106461346 A 2/2017

(Continued)

OTHER PUBLICATIONS

International Search Report dated Dec. 5, 2017 in PCT/JP2017/031030 filed on Aug. 29, 2017, citing references AA, AB, AD, AE, AG, and AN-AT therein, 2 pages.

(Continued)

*Primary Examiner* — Devon Russell
(74) *Attorney, Agent, or Firm* — Oblon, McClelland, Maier & Neustadt, L.L.P.

(57) ABSTRACT

A heat exchanger includes a first flow channel and a second flow channel that are alternately stacked in a stacking direction, each of the first flow channel and the second flow channel including: upstream parts disposed parallel to one another in a direction perpendicular to the stacking direction and to a direction in which the flow channels extend; downstream parts disposed parallel to one another in a direction perpendicular to the stacking direction and to a direction in which the flow channels extend; and branching/merging parts configured to branch the flow channels immediately upstream of the branching/merging parts into two divergent channels and merge the divergent channels adjacent to one another to form next flow channels, between the upstream parts and the downstream parts, wherein the branching/merging parts are provided in a plurality of stages between the upstream parts and the downstream parts.

11 Claims, 18 Drawing Sheets

(56) References Cited

U.S. PATENT DOCUMENTS

| | | | | |
|---|---|---|---|---|
| 6,866,955 | B2 | 3/2005 | Lee et al. | |
| 7,334,631 | B2 * | 2/2008 | Kato | F28D 9/005 165/166 |
| 9,033,030 | B2 * | 5/2015 | Des Champs | F28F 13/08 165/166 |
| 9,574,709 | B2 | 2/2017 | Seki et al. | |
| 10,234,217 | B2 * | 3/2019 | Shao | F28F 21/04 |
| 10,288,354 | B2 | 5/2019 | Choi et al. | |
| 10,641,555 | B2 * | 5/2020 | Tokozakura | F28D 9/0093 |
| 2005/0130003 | A1 | 6/2005 | Lee et al. | |
| 2009/0294113 | A1 | 12/2009 | Cha et al. | |
| 2010/0051248 | A1 * | 3/2010 | Inatomi | F28D 9/0037 165/166 |
| 2013/0192806 | A1 | 8/2013 | Noishiki et al. | |
| 2015/0118514 | A1 * | 4/2015 | Zhao | B32B 3/28 428/603 |
| 2015/0345705 | A1 | 12/2015 | Seki et al. | |
| 2016/0131434 | A1 | 5/2016 | Noishiki et al. | |
| 2017/0023311 | A1 * | 1/2017 | Urbanski | F28D 9/0037 |
| 2017/0328644 | A1 | 11/2017 | Takahashi | |

FOREIGN PATENT DOCUMENTS

| | | | | | |
|---|---|---|---|---|---|
| EP | 0 625 688 | A1 | | 11/1994 | |
| EP | 2 910 841 | A1 | | 8/2015 | |
| EP | 3 029 406 | A1 | | 6/2016 | |
| GB | 2 162 302 | A | | 1/1986 | |
| JP | 2005-526367 | A | | 9/2005 | |
| JP | 2008-128574 | A | | 6/2008 | |
| JP | 2013-155971 | A | | 8/2013 | |
| JP | 2015-31420 | A | | 2/2015 | |
| JP | 2015031420 | A | * | 2/2015 | F02M 21/0206 |
| JP | 2015-114080 | A | | 6/2015 | |
| JP | 2016-90157 | A | | 5/2016 | |
| JP | 2016-130625 | A | | 7/2016 | |
| WO | WO 2008/062802 | A1 | | 5/2008 | |
| WO | WO 2015/098158 | A1 | | 7/2015 | |

OTHER PUBLICATIONS

Combined Chinese Office Action and Search Report dated Jan. 29, 2021 in corresponding Chinese Patent Application No. 201780094474.9 (with English Translation and English Translation of Category of Cited Documents) citing documents AO and AP therein, 16 pages.

Extended European Search Report dated Feb. 15, 2021 in corresponding European Patent Application No. 17923406.7 citing documents AQ-AT therein, 7 pages.

* cited by examiner

HEAT EXCHANGER

FIELD

The present invention relates to a heat exchanger that exchanges heat among fluids that flow through a plurality of flow channels.

BACKGROUND

The development of hydrogen supply stations for supplying hydrogen to fuel-cell vehicles is underway in order to build a social infrastructure corresponding to proliferation of fuel-cell vehicles that have relatively low impacts on the environment. When hydrogen is supplied to a hydrogen tank of a fuel-cell vehicle, residual gas in the hydrogen tank suffers adiabatic compression, which results in temperature rise. For this reason, it is desirable that hydrogen thus supplied have a low temperature. It is also desirable that hydrogen have sufficiently high pressure for reduction of time for filling the tank and for size reduction of the tank.

For these reasons, there is a technique (for example, see Patent Literature 1) by which hydrogen is cooled by a high-pressure resistant heat exchanger provided at a midway position in a pipe channel through which hydrogen is supplied to a fuel-cell vehicle from a hydrogen tank that is a supply source of a hydrogen supply station. Some hydrogen supply stations employ multistage compression by which hydrogen is sequentially passed through a plurality of compressors, whereby hydrogen compressed by a compressor is further compressed by another compressor in the next stage. In such a case, using a single multipipe heat exchanger to cool hydrogen in all stages of compression is convenient (for example, see Patent Literature 2).

Other than hydrogen supply stations, there are applications that demand the use of a highly efficient and high-pressure resistant heat exchanger. Examples of heat exchangers proposed thus far include one that includes microchannels (for example, see Patent Literature 3) and one aimed at uniformly distributing fluid and characterized by a certain device in a header flow channel (for example, see Patent Literature 4).

CITATION LIST

Patent Literature

Patent Literature 1: WO 2015/098158
Patent Literature 2: Japanese Patent Application Laid-open No. 2013-155971
Patent Literature 3: Japanese Patent Application Laid-open No. 2015-114080
Patent Literature 4: Japanese Patent Application Laid-open No. 2016-90157

SUMMARY

Technical Problem

While the development of heat exchangers is thus underway, a sufficiently highly efficient heat exchanger has yet to be available, and, as the situation stands, a heat exchanger that meets specifications requested for a hydrogen supply station is large and expensive. Given this situation, a heat exchanger that is not only highly efficient and high-pressure resistant but also further smaller and less expensive is demanded for further proliferation of hydrogen supply stations.

The present invention has been made in view of the above circumstances and is directed to providing a heat exchanger that is not only highly efficient and high-pressure resistant but also small and inexpensive.

Solution to Problem

To solve the problem and achieve the object, a heat exchanger according to the present invention includes: a plurality of flow channels, wherein the heat exchanger is configured to exchange heat between fluid flowing through the plurality of flow channels, the plurality of flow channels include: a first flow channel through which first fluid flows; and a second flow channel through which second fluid having a temperature different from a temperature of the first fluid flows, the first flow channel and the second flow channel are provided in such a manner as to be alternately stacked in a stacking direction perpendicular to a direction in which the flow channels extend, each of the first flow channel and the second flow channel includes: upstream parts and downstream parts disposed parallel in a direction perpendicular to the stacking direction and to a direction in which the flow channels extend, and branching/merging parts configured to branch the flow channels immediately upstream of the branching/merging parts into two divergent channels and merge the divergent channels adjacent to one another to form next flow channels, between the upstream parts and the downstream parts, wherein the branching/merging parts are provided in a plurality of stages between the upstream parts and the downstream parts.

With the above-described branching/merging parts provided, in fluid flowing through the first flow channels or the second flow channels, the following operation is repeated: while portions flowing near the walls of the flow channels and having relatively large increases in temperature by receiving heat from those walls of the flow channels are guided into the center part, portions flowing in the central parts and having relatively low increases in temperature by receiving little heat from the walls of the flow channels are conversely guided toward the walls of the flow channels. As the same time, in fluid flowing through the other flow channels, the following operation is repeated: while portions flowing near the walls of the flow channels and having relatively large decreases in temperature by releasing heat to those walls of the flow channels are guided into the center part, portions flowing in the central parts and having relatively low decreases in temperature by releasing little heat to the walls of the flow channels are conversely guided toward the walls of the flow channels. This configuration can result in increased differences in temperature between fluid and the walls of the flow channels, thus enhancing the efficiency of heat releasing and heat receiving.

Moreover, in the heat exchanger according to the present invention, the branching/merging parts are grouped into first branching/merging parts configured to branch N number of flow channels immediately upstream of the branching/merging parts into the two divergent channels and merge the divergent channels adjacent to one another excluding the two outermost divergent channels to form next N+1 number of flow channels, and second branching/merging parts configured to branch N−1 number of flow channels, out of the N+1 number of flow channels excluding the two outermost flow channels, immediately upstream of the second branching/merging parts, into the two divergent channels and merge the divergent channels adjacent to one another including the two outermost flow channels to form next N number of flow channels, and the first branching/merging parts and the second branching/merging parts are alternately provided in a plurality of stages between the upstream parts and the downstream parts.

According to this configuration, the number of flow channels is initially N and is configured to increase only by one to (N+1) and then decreases only by one to N a plurality of times, whereby the number of flow channels neither extremely increases nor extremely decreases. Additionally, the area of the flow channels can be appropriately kept within a certain range, and little dead space is left in formation of flow channels. The heat exchange efficiency per unit cubic volume is thus enhanced.

Moreover, the heat exchanger according to the present invention further includes linear flow channels provided between two of the branching/merging parts that are adjacent to each other in the direction in which the flow channels extend, the linear flow channels being parallel to the direction in which the flow channels extend. According to this configuration, it is possible for the fluid to flow stably and laminar flow can be maintained easily.

Moreover, in the heat exchanger according to the present invention, the two divergent channels being configured to branch or merge in the branching/merging parts are symmetric with respect to a direction in which the flow channels extend, with apexes of branching having an angle of 180 degrees or less. According to this configuration, it is easy to diverge with laminar flow being maintained.

Moreover, in the heat exchanger according to the present invention, first plates and second plates are stacked on one another in a part in which heat is exchanged, the first flow channels are formed as grooves between front faces of the first plates and back faces of the second plates, the second flow channels are formed as grooves between front faces of the second plates and back faces of the first plates, and the first plates and the second plates are bonded to each other by diffusion bonding.

According to this configuration, the first flow channels and the second flow channels can be constructed as a large number of narrow-diameter channels, that is, what are called microchannels, whereby, while the total area of the walls of the flow channels can be increased, the first flow channels can be disposed close to the second flow channels. As a result, the heat exchange efficiency increases. Additionally, the use of diffusion bonding allows for highly strong bonding and consequently higher high-pressure resistance.

Moreover, in the heat exchanger according to the present invention, the second fluid is coolant having a lower temperature than the first fluid, and the first fluid is hydrogen gas having a higher temperature than the second fluid. According to this configuration, it is suitable for use in a hydrogen supply station.

Moreover, in the heat exchanger according to the present invention, the second fluid is coolant having a lower temperature than the first fluid, the first fluid is fluid having a higher temperature than the second fluid, and the divergent channels in the first flow channels are formed more narrowly than the divergent channels in the second flow channels. According to this configuration, it is suitable in terms of heat exchange performance and pressure resistance perspective.

Moreover, in the heat exchanger according to the present invention, the plurality of flow channels include three or more kinds of flow channels including the first flow channel and the second flow channel, and each of the flow channels are provided in such a manner so as to be stacked in the stacking direction, and each of the flow channels includes the upstream part, the downstream part, and the branching/merging part.

Advantageous Effects of Invention

According to the heat exchanger according to the present invention, the branching/merging parts are provided. As a result, in fluid flowing through the first flow channels or the second flow channels, the following operation is repeated: while portions flowing near the walls of the flow channels and having relatively large increases in temperature by receiving heat from those walls of the flow channels are guided into the center part, portions flowing in the central parts and having relatively low increases in temperature by receiving little heat from the walls of the flow channels are conversely guided toward the walls of the flow channels. As the same time, in fluid flowing through the other flow channels, the following operation is repeated: while portions flowing near the walls of the flow channels and having relatively large decreases in temperature by releasing heat to those walls of the flow channels are guided into the center part, portions flowing in the central parts and having relatively low decreases in temperature by releasing little heat to the walls of the flow channels are conversely guided toward the walls of the flow channels. This configuration can result in increased differences in temperature between fluid and the walls of the flow channels, thus enhancing the efficiency of heat releasing and heat receiving.

BRIEF DESCRIPTION OF DRAWINGS

FIG. 10-1 is an enlarged view of a first branching/merging part on a coolant flow channel on an upper face of the first plate.

FIG. 10-2 is an enlarged view of the first branching/merging part on a hydrogen flow channel in a lower face of the first plate.

DESCRIPTION OF EMBODIMENTS

Figure 1:
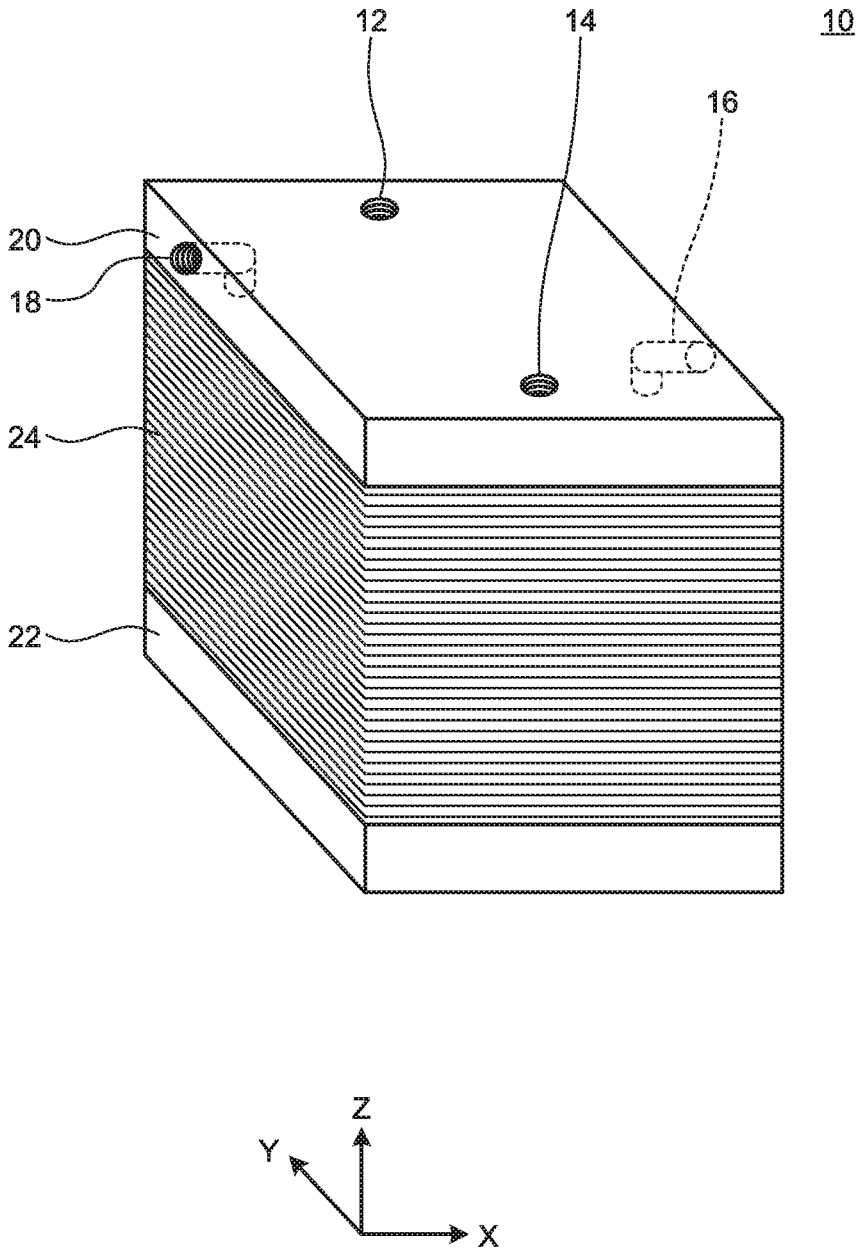
FIG. 1 is a perspective view of a heat exchanger according to a first embodiment.

The following describes embodiments of a heat exchanger according to the present invention in detail based on the drawings. These embodiments are not intended to limit the present invention. For easier understanding of directions, arrows X, Y, and Z perpendicular to one another are presented as appropriate in the drawings. These arrows X, Y, and Z consistently indicate the same directions throughout the drawings.

As illustrated in FIG. 1, a heat exchanger 10 according to a first embodiment is box-shaped and includes a hydrogen inlet 12, a hydrogen outlet 14, a coolant inlet 16, and a coolant outlet 18. A coolant flow channel (second flow channel) communicates between the coolant inlet 16 and the coolant outlet 18, a hydrogen flow channel (first flow channel) communicates between the hydrogen inlet 12 and the hydrogen outlet 14, and heat is exchanged between coolant (second fluid) and hydrogen (first fluid) that flow through these flow channels.

When hydrogen is supplied to a fuel tank of a fuel-cell vehicle from a hydrogen storage tank in a hydrogen supply station, for example, the heat exchanger 10 is provided in a supply pipeline between the hydrogen storage tank and the vehicle's fuel tank and is capable of cooling gaseous hydrogen at 100 MPa to about −40 degrees Celsius. As the coolant, FP-40 of brine is used for example. FP-40 has an excellent thermal performance, a high heat transfer coefficient, and low viscosity and is suitable in terms of cost and from a hygiene perspective.

The heat exchanger 10 includes an upper header 20, a lower header 22, and a plate stack part 24 provided between these headers. The hydrogen inlet 12 is provided in the far side on the upper face of the upper header 20 in the Y-direction; the hydrogen outlet 14 is provided in the near side thereon in the Y-direction; the coolant inlet 16 is provided on the right face in the near side in the Y-direction; and the coolant outlet 18 is provided on the left face in the far side in the Y-direction. Respective connectors can be attached to the hydrogen inlet 12, the hydrogen outlet 14, the coolant inlet 16, and the coolant outlet 18. The hydrogen inlet 12 and the hydrogen outlet 14 penetrate in the Z-direction. The coolant inlet 16 and the coolant outlet 18 extend by short lengths in the X-direction inside the upper header 20, then bend, and open downward. It has been verified by the inventor of the present application that the heat exchanger 10 can be configured in a small size. Therefore, for example, installing the heat exchanger 10 in a dispenser (corresponding to a fueling pump in a gasoline station) in a hydrogen supply station is feasible.

The plate stack part 24 is a part in which heat is exchanged between hydrogen and coolant. The depth direction (Y-direction) in this part is a direction in which the flow channels run. While hydrogen flows from the far side to the near side, coolant contrarily flows from the near side to the far side.

Figure 2:
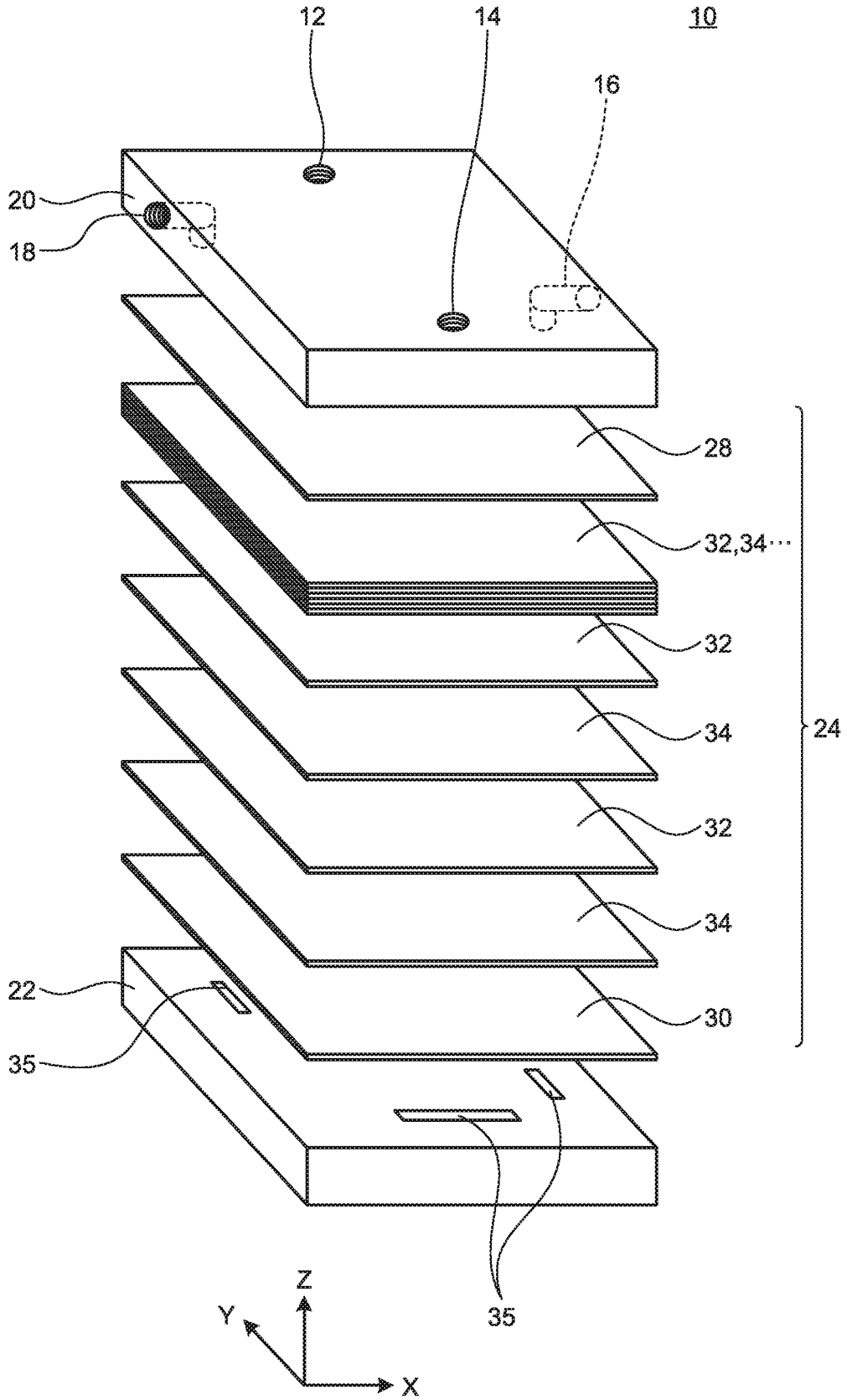
FIG. 2 is an exploded perspective view of the heat exchanger according to the first embodiment.

As illustrated in FIG. 2, the plate stack part 24 is composed of plates of four kinds stacked in the Z-direction (stacking direction), which is the height direction. Specifically, those plates are: a single upper end plate 28 disposed immediately below the upper header 20; a single lower end plate 30 disposed immediately above the lower header 22; and a plurality of first plates 32 and a plurality of second plates 34 disposed alternately therebetween. The first plates 32 and the second plates 34 are each 92 plates stacked, for example. The upper header 20, the lower header 22, the upper end plate 28, the lower end plate 30, the first plates 32, and the second plates 34 described above are made of a stainless steel material, which is, for example, a SUS316L material, and are bonded together by diffusion bonding. The use of a stainless steel material imparts high strength to the walls of the flow channels and the entire structure, imparts excellent thermal conductivity and excellent corrosion resistance, and prevents corrosion despite the presence of brine in coolant. A copper material, a steel material, or an aluminum material, which has a heat transfer coefficient, may be used instead of a stainless steel material. In addition, different materials may be used in different parts. Furthermore, the use of diffusion bonding enables the plates to be strongly bonded together, thereby allowing for high-pressure resistant specifications.

The upper end plate 28, the lower end plate 30, the first plates 32, and the second plates 34 have a thickness of, for example, 1.2 mm and have respective notches for identification in different positions although the notches are not illustrated. In FIG. 1, the numbers of plates illustrated as the first plates 32 and the second plates 34 are smaller than the above-described numbers because of limitations of expression through illustration. In FIG. 2, further smaller numbers of plates are illustrated as the first plates 32 and the second plates 34. In FIG. 2, some of the plates are illustrated as being stacked together in a manner that allows clear visual understanding of how these plates are stacked.

Figure 3:
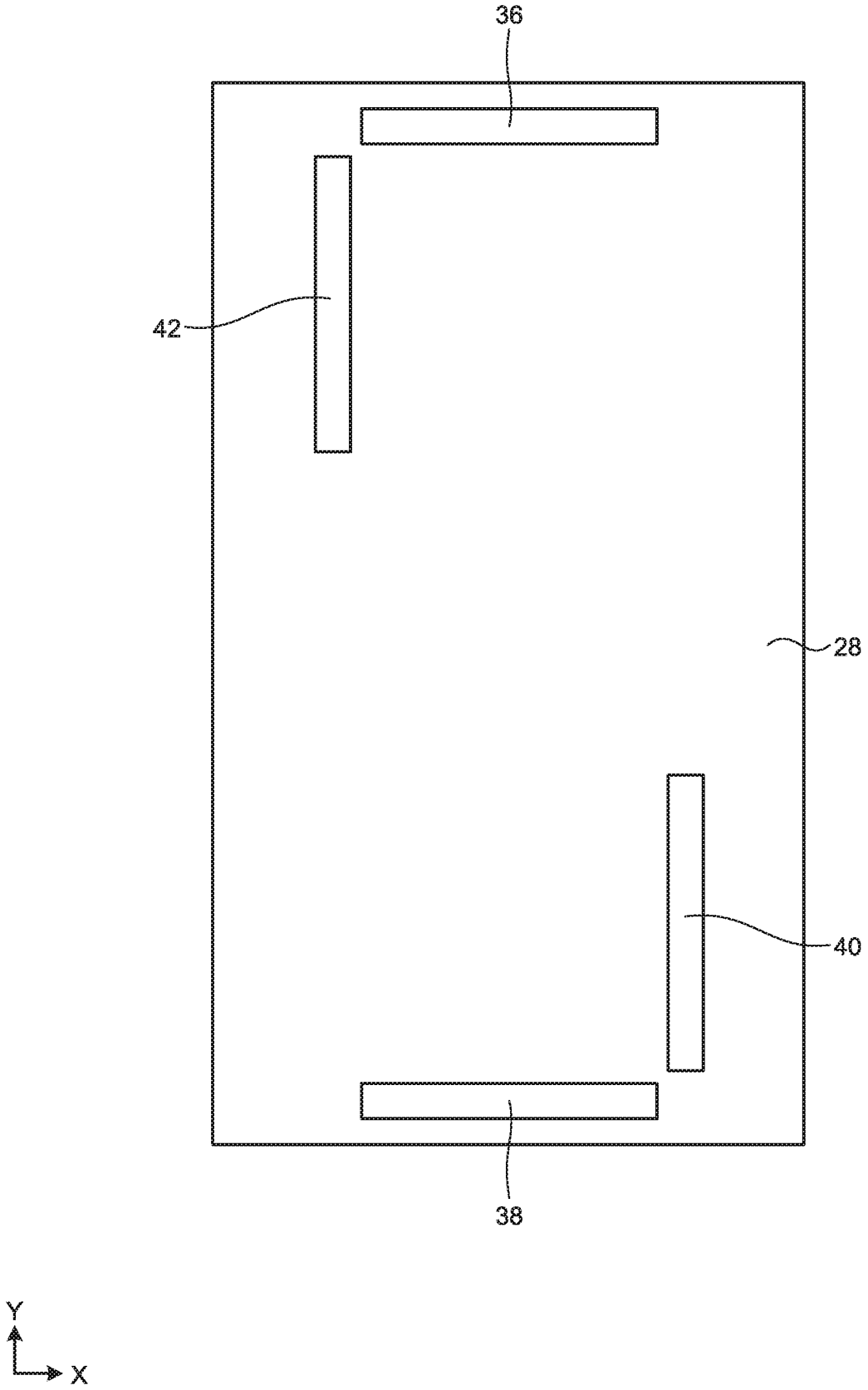
FIG. 3 is a top view of an upper end plate.

As illustrated in FIG. 3, in the top view, the upper end plate 28 includes: a hydrogen supply hole 36 extending in the X-direction in the neighborhood of an edge of the upper end plate 28 in the upper part of the page; a hydrogen discharge hole 38 extending in the X-direction in the neighborhood of an edge thereof in the lower part of the page; a coolant supply hole 40 extending in the Y-direction in the neighborhood of an edge thereof in the lower right part of the page; and a coolant discharge hole 42 extending in the Y-direction in the neighborhood of an edge thereof in the upper left side of the page. The hydrogen supply hole 36, the hydrogen discharge hole 38, the coolant supply hole 40, and the coolant discharge hole 42 are shaped in elongated rectangles and are all provided in the upper end plate 28, the first plates 32, the second plates 34, and the lower end plate 30 in such a manner as to penetrate the plate stack part 24. Grooves 35 are provided on the upper face of the lower header 22 (see FIG. 2) in positions corresponding to the hydrogen supply hole 36, the hydrogen discharge hole 38, the coolant supply hole 40, and the coolant discharge hole 42.

While the hydrogen supply hole 36 communicates with a lower opening of the hydrogen inlet 12 (see FIG. 2), the hydrogen discharge hole 38 communicates with a lower opening of the hydrogen outlet 14. While the coolant supply hole 40 communicates with a lower opening of the coolant inlet 16, the coolant discharge hole 42 communicates with a lower opening of the coolant outlet 18.

The hydrogen supply hole 36 and the hydrogen discharge hole 38 are disposed so as to be symmetric between the upper and lower sides and between the right and left sides. The coolant supply hole 40 and the coolant discharge hole 42 are disposed so as to be point symmetric with respect to the center points of the first plates 32. The lower face (back face) of the upper end plate 28 has the same shape as the lower face (see FIG. 7) of the second plates 34 described below.

Figure 4:
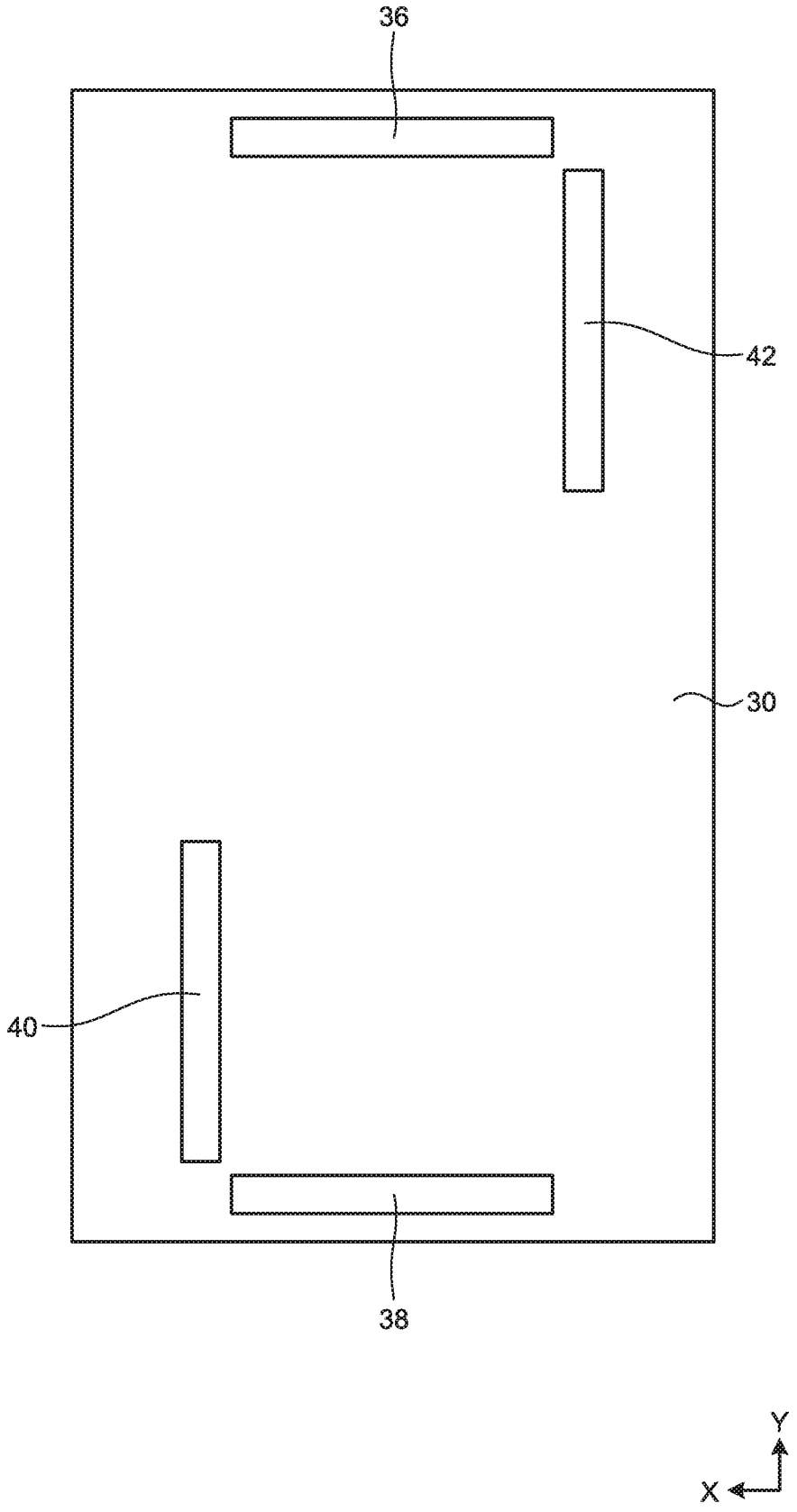
FIG. 4 is a bottom view of a lower end plate.

As illustrated in FIG. 4, the lower face of the lower end plate 30 is mirror-symmetric between the right and left sides to the upper face of the upper end plate 28 illustrated in FIG. 3. Therefore, after the completion of assembly of the heat exchanger 10 as a product, the respective positions of the hydrogen supply hole 36, the hydrogen discharge hole 38, the coolant supply hole 40, and the coolant discharge hole 42 (hereinafter collectively referred to as penetrating elements) on each of the plates perfectly overlap the positions thereof on the other plates as viewed transparently from the top. As described below, each of these penetrating elements overlaps the corresponding penetrating element across the first plates 32 and across the second plates 34. The upper face of the lower end plate 30 has the same shape as the upper face (see FIG. 5) of the first plates 32 described below.

Next, regarding the flow channels in the plate stack part 24, the coolant flow channels are mainly described with reference to FIG. 5 to FIG. 8, and the hydrogen flow channels are mainly described with reference to FIG. 9 to FIG. 11.

Figure 5:
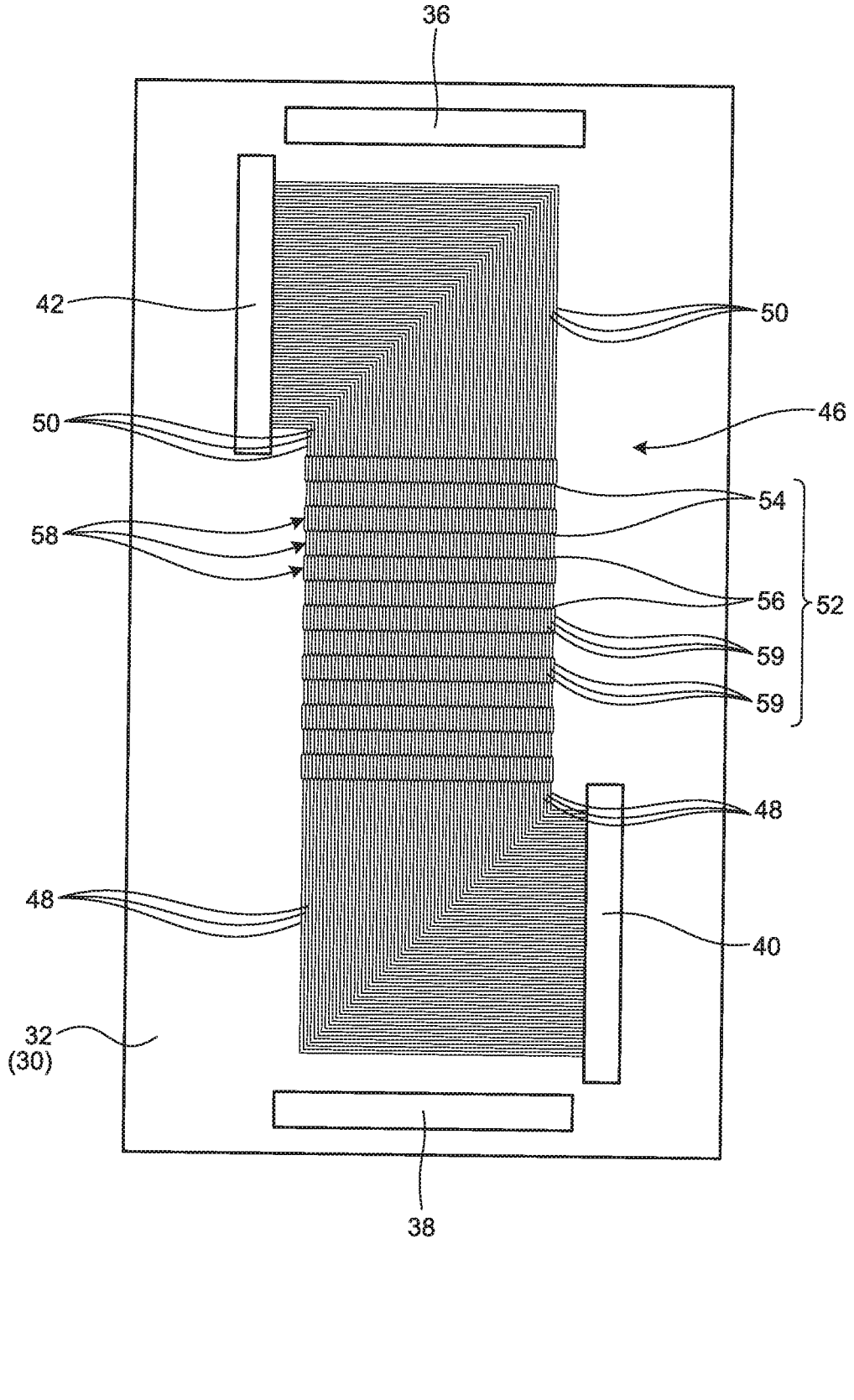
FIG. 5 is a top view of either a first plate or the lower end plate.

As illustrated in FIG. 5, the upper face of each of the first plates 32 has the penetrating elements disposed in the same positions as these elements are disposed on the upper face of the upper end plate 28 (see FIG. 3). The upper face of the first plate 32 further includes a coolant narrow groove cluster 46 that connects the coolant supply hole 40 and the coolant discharge hole 42 to each other for communication therebetween.

The coolant narrow groove cluster 46 includes: 70 (or N) coolant upstream narrow channels (upstream parts) 48 communicating with the coolant supply hole 40; 70 coolant downstream narrow channels (downstream parts) 50 communicating with the coolant discharge hole 42; and a honeycomb part 52 forming multistage flattened hexagons between the coolant upstream narrow channels 48 and the coolant downstream narrow channels 50 by having flow channels branching/merging at multiple locations. The honeycomb part 52 is provided between parts of the 70 coolant upstream narrow channels 48 and parts of the 70 coolant downstream narrow channels 50. These parts of the coolant upstream narrow channels 48 and the coolant downstream narrow channels 50 are, other than bent parts thereof immediately connecting to the coolant supply hole 40 and the coolant discharge hole 42, parallel to the X-direction, which is the depth direction perpendicular to the flow channel direction (Y-direction) and the stacking direction (Z-direction).

Each of the coolant upstream narrow channels 48 extends leftward from the coolant supply hole 40, then bends upward by 90 degrees, and connects to the honeycomb part 52. Each of the coolant downstream narrow channels 50 extends rightward from the coolant discharge hole 42, then bends downward by 90 degrees, and connects to the honeycomb part 52. The honeycomb part 52 extends in the Y-direction between the hydrogen supply hole 36 and the hydrogen discharge hole 38.

In the coolant narrow groove cluster 46, toward the right side in FIG. 5, the coolant downstream narrow channels 50 connecting to the coolant discharge hole 42 are longer, and the coolant upstream narrow channels 48 connecting to the coolant supply hole 40 are shorter. In contrast, toward the left side in FIG. 5, the coolant downstream narrow channels 50 connecting to the coolant discharge hole 42 are shorter, and the coolant upstream narrow channels 48 connecting to the coolant supply hole 40 are longer. Accordingly, the coolant narrow groove cluster 46 has substantially the same distance between the coolant supply hole 40 and the coolant discharge hole 42 regardless of the closeness to the left side or to the right side. The coolant narrow groove cluster 46 is provided also on the lower face of each of the second plates 34 (see FIG. 7) and on the lower face of the upper end plate 28 so as to be mirror-symmetric between the right and left sides to the coolant narrow groove cluster 46 illustrated in FIG. 5. Each adjacent upper and lower two of the coolant narrow groove clusters 46 make up microchannels of narrow diameters when being laid on each other, thereby forming coolant flow channels.

Figure 6:
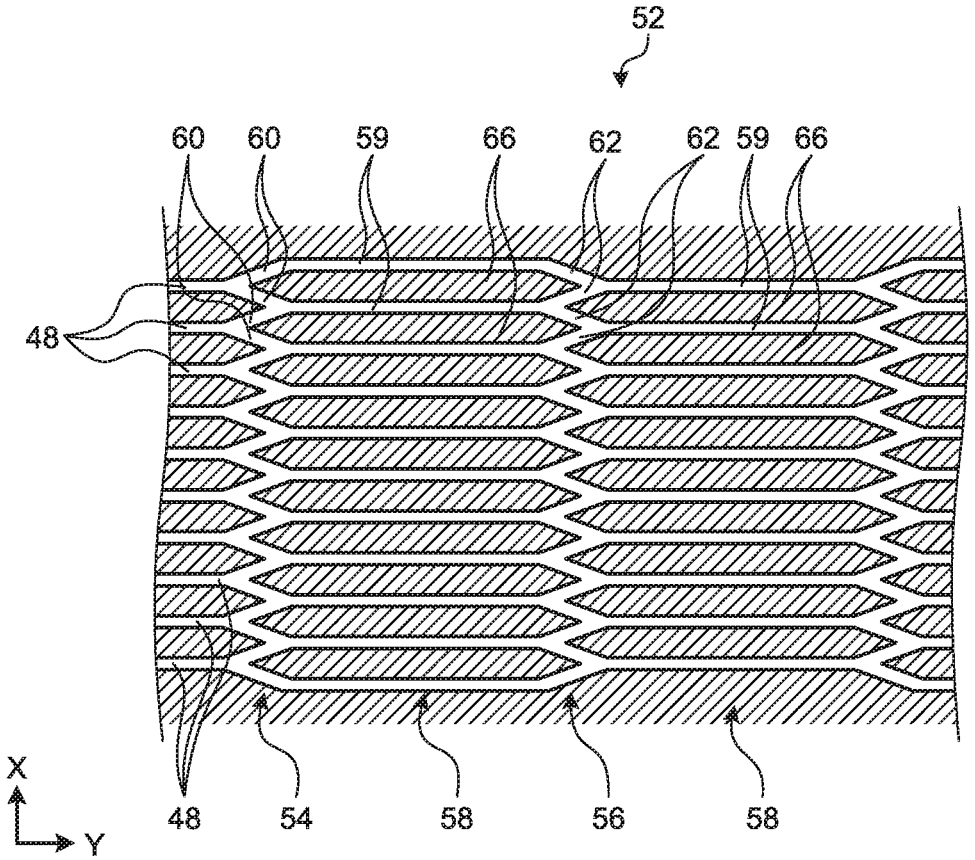
FIG. 6 is a partially enlarged view of a coolant narrow groove cluster.

As illustrated in FIG. 6, the honeycomb part 52 includes first branching/merging parts 54, second branching/merging parts 56, and linear flow channel parts 58 formed between adjacent ones of the first branching/merging parts 54 and the second branching/merging parts 56. The respective first branching/merging parts 54 are provided in a plurality of stages, so are the second branching/merging parts 56, and so are the linear flow channel parts 58. In the linear flow channel part 58 that is located downstream of each of the first branching/merging parts 54, 71 intermediate linear narrow channels (linear flow channel) 59 parallel to and equally spaced between each other are formed. In the linear flow channel part 58 that is located downstream of each of the second branching/merging parts 56, 70 intermediate linear narrow channels 59 parallel to and equally spaced between each other are formed. Each of these intermediate linear narrow channels 59 is formed adequately long such that a growth part of flow can be harnessed, that a laminar flow can be obtained easily, and that a pressure loss can be smaller.

The first branching/merging parts 54 are configured in such a manner that: each of the 70 (N) coolant upstream narrow channels 48 or the 70 (N) intermediate linear narrow channels 59 that are immediately upstream of each of the first branching/merging parts 54 branches into two divergent channels 60, 60; and every two adjacent ones of the divergent channels 60, 60 other than the two outermost ones merge together into the 71 (or N+1) intermediate linear narrow channels 59 immediately downstream of the first branching/merging part 54. The second branching/merging parts 56 are configured in such a manner that: each of the 69 (or N−1) flow channels out of the 71 flow channels immediately upstream of each of the second branching/merging parts 56 other than the two outermost flow channels branches into two divergent channels 62, 62; and every two adjacent ones of the divergent channels 62, 62 merge together into the 70 intermediate linear narrow channels 59 or the 70 coolant downstream narrow channels 50.

The respective first branching/merging parts 54 are provided in seven stages, and so are the second branching/merging parts 56. The respective first branching/merging parts 54 are alternately provided between the coolant upstream narrow channels 48 and the coolant downstream narrow channels 50 (see FIG. 5). Accordingly, while seven portions each having 71 flow channels and having a slightly wider width are formed, six portions each located between adjacent two of the seven portions, having 70 flow channels, and having a slightly narrower width wider width are formed.

Between the first branching/merging part 54 and the second branching/merging part 56 that are adjacent to each other in a direction along the flow channels, the intermediate linear narrow channels 59 parallel to one another that run in the direction along the flow channels. The two divergent channels 60, 60 that branch in each of the first branching/merging parts 54 are symmetric with respect to a direction in which the flow channels run, with the apexes of a branching part and a merging part being acute-angled (for example at 45 degrees); and so are the two divergent channels 62, 62 that branch in each of the second branching/merging parts 56. An applicable angle of the apexes is 180 degrees or less. The apexes may be rounded. Furthermore, as can be understood from FIG. 6, in each of the first branching/merging parts 54 and each of the second branching/merging parts 56, the branching parts are close to the merging parts, and the channels branch and merge almost at the same time.

The honeycomb part 52 thus configured has a large number of flattened hexagonal island parts 66 formed in multistage layers arrayed in the upward, downward, rightward, and leftward directions by the first branching/merging parts 54, the second branching/merging parts 56, the linear flow channel parts 58, thus having a kind of honeycomb shape.

Regarding the dimensions of each of the grooves of the coolant upstream narrow channels 48, the coolant downstream narrow channels 50, and the intermediate linear narrow channels 59, the flow channels each have a semicircular cross-section of a width of 0.5 mm and a depth of 0.25 mm and have 1.0-mm pitches in the Y-direction, for example. Each of these flow channels has a groove shape and is formed with high precision through etching processing, laser processing, or machine processing.

Figure 7:
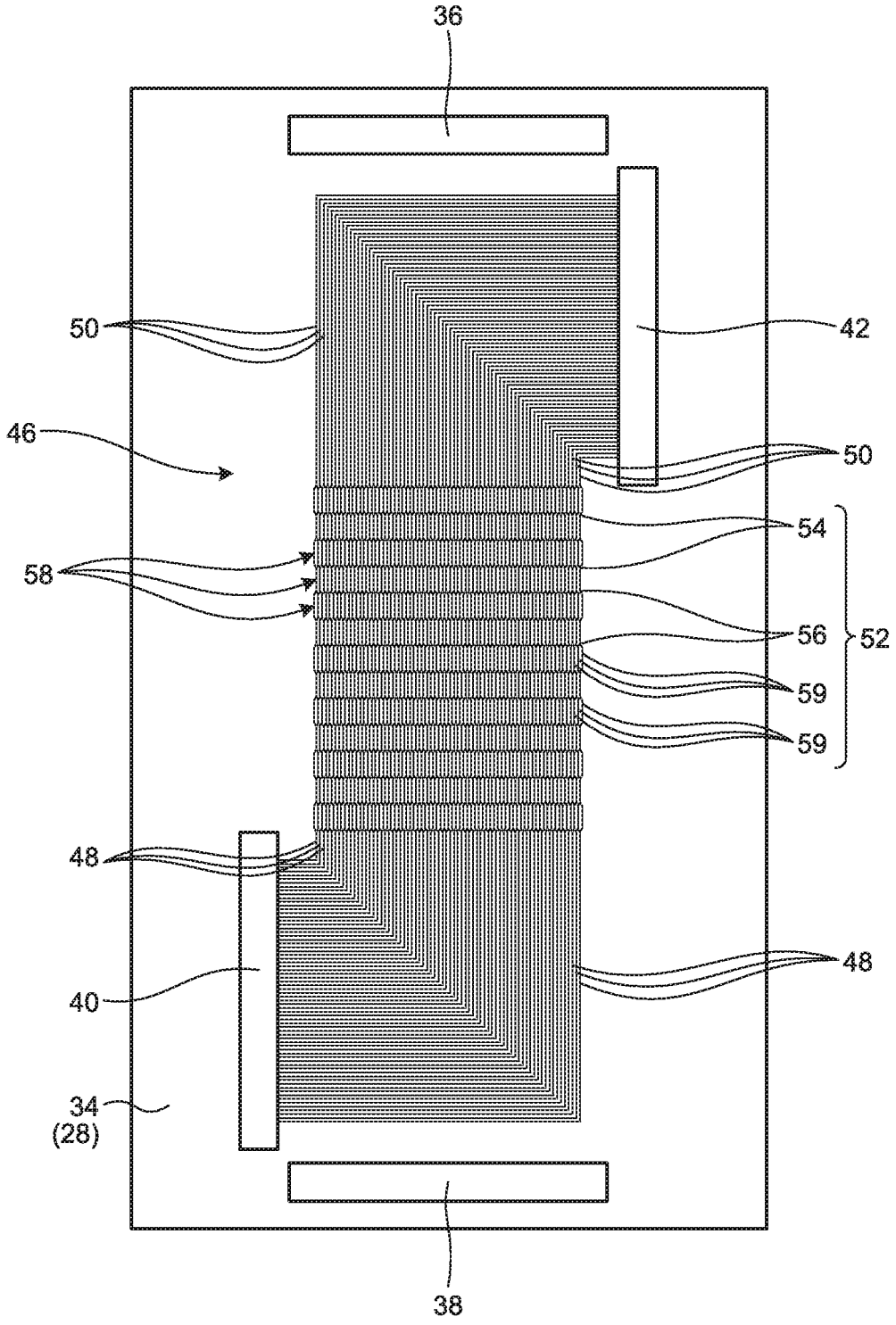
FIG. 7 is a bottom view of a second plate and the upper end plate.
Figure 7:
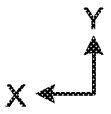
Figure 8:
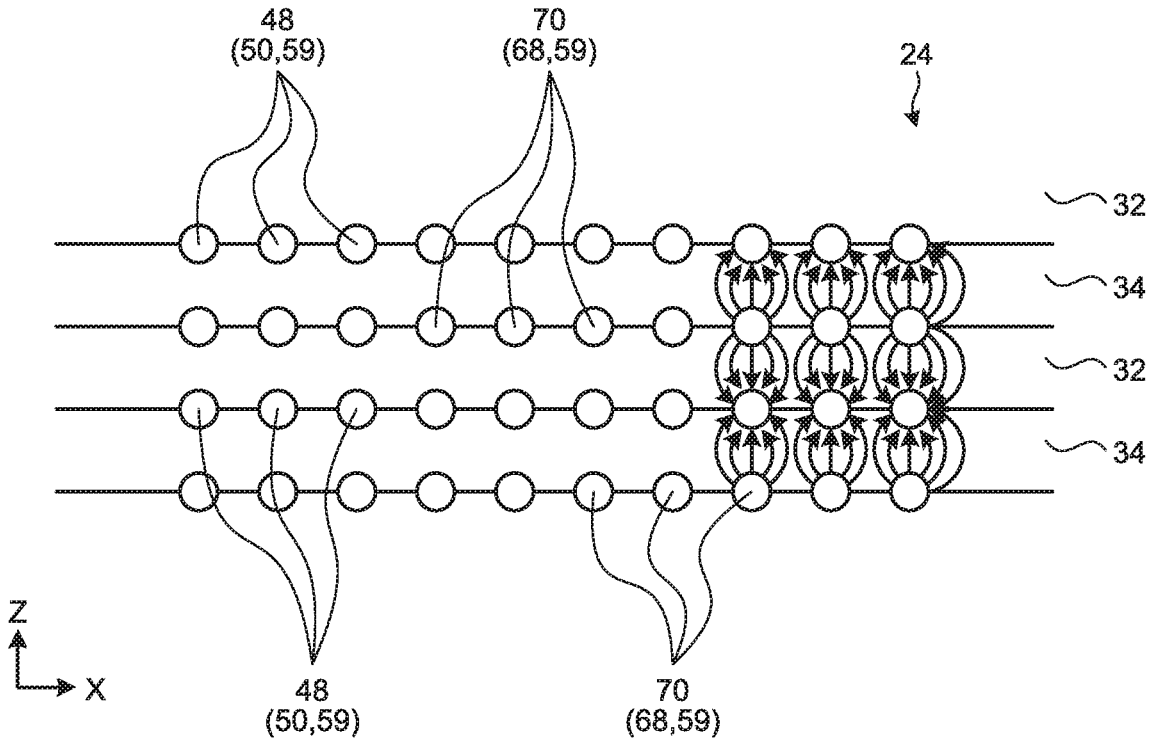
FIG. 8 is a partially enlarged cross-sectional side view of a plate stack part.

As illustrated in FIG. 7, the lower face of the second plate 34 is mirror-symmetric between the right and left sides to the upper face of the first plate 32 illustrated in FIG. 5. Accordingly, these groove parts form upper walls and lower walls with the upper face of the first plate 32 and the lower face of the second plate 34 abutting each other as illustrated in FIG. 8, and the dimension of each flow channel in the height direction thereof is 0.5 mm (0.25 mm×2). The flow channels formed by the groove parts each have a circular cross-section having a diameter of 0.5 mm, and the flow is more likely to be stable. Thus, the first flow channel serving as the hydrogen flow channel and the second flow channel serving as the coolant flow channel run parallel to each other in the Z-direction and are formed in stacked shapes. For the sake of easier understanding, the flow of heat from the hydrogen flow channels on the high-temperature side to the coolant flow channels on the low-temperature side is schematically illustrated by arrows in a part of FIG. 8. As can be understood by those schematic arrows, heat exchange (in other words, heat releasing and heat receiving) works to considerable degrees not only in the thickness direction of the thin plates (the Z-direction) but also in directions from the left and the right walls (the X-direction). As described later, the heat exchanger 10 and a heat exchanger 10*a* are improved in heat exchange efficiency particularly in those directions from the walls.

Next, the hydrogen flow channels are mainly described with reference to FIG. 9 to FIG. 11.

Figure 9:
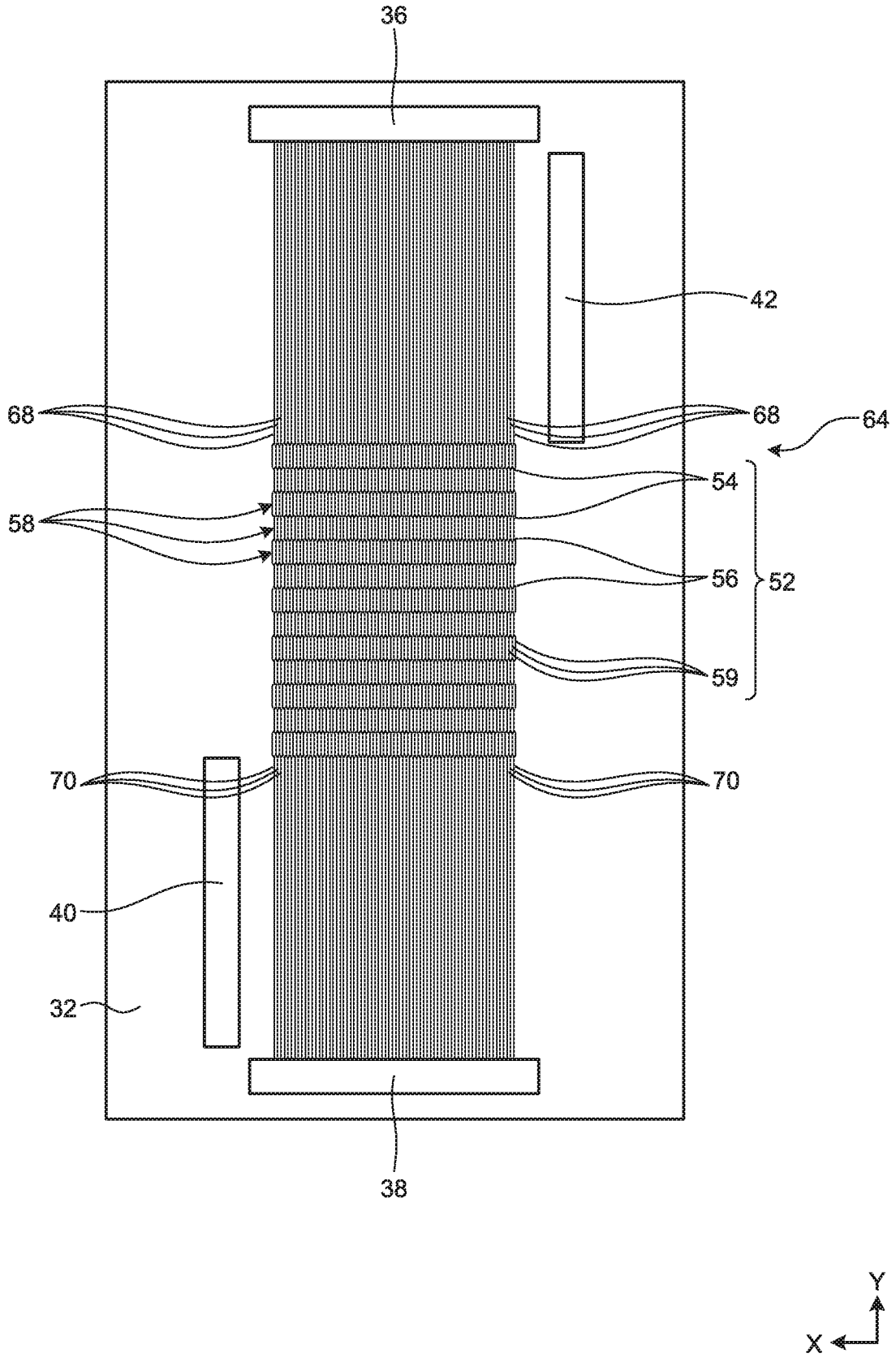
FIG. 9 is a bottom view of the first plate.

As illustrated in FIG. 9, on the lower face of each of the first plates 32, the positions of the penetrating elements are naturally mirror-symmetric between the right and left sides to those on the upper face thereof (see FIG. 5), and are the same as those on the lower face of the lower end plate 30 (see FIG. 4) and as those of the lower face of each of the second plates 34 (see FIG. 7). Additionally, hydrogen narrow groove clusters 64 are provided. Each of the hydrogen narrow groove clusters 64 linearly connects the hydrogen supply hole 36 in a corresponding one of the plates and the hydrogen discharge hole 38 in the plate immediately below the foregoing plate for communication therebetween. Each of the hydrogen narrow groove clusters 64 is symmetrical between the upper and lower sides and between the left and right sides. The hydrogen narrow groove cluster 64 is provided also on the upper face of each of the second plates 34 (see FIG. 11). The adjacent upper and lower hydrogen narrow groove clusters 64 make up microchannels of narrow diameters when being laid on each other, thereby forming hydrogen flow channels.

While the hydrogen flow channels are formed as grooves between the upper face of each of the first plates 32 and the lower face of the second plate 34 immediately above that first plate 32, the coolant flow channels are formed as grooves between the upper face of each of the second plates 34 and the lower face of the first plate 32 immediately above that second plate 34. Accordingly, the hydrogen flow channels and the coolant flow channels can be constructed as a large number of narrow-diameter channels, that is, what are called microchannels, whereby, while the total area of the walls of the flow channels can be increased, the hydrogen flow channels can be disposed close to the coolant flow channels. As a result, the heat exchange efficiency increases. Additionally, the use of diffusion bonding allows for highly strong bonding and consequently higher high-pressure resistance. Furthermore, compared with a case in which grooves are formed on any one of the front face or the back face of each of the plates, the number of plates is half, the number of times washing is performed is half, and the time needed for stacking is half. The present embodiment is thus advantageous in manufacturing.

Each of the hydrogen narrow groove clusters 64 has a honeycomb part 52. This honeycomb part 52 basically has the same shape as that in the coolant narrow groove cluster 46 (see FIG. 5), and includes: 70 (or N) hydrogen upstream narrow channels (upstream parts) 68 communicating with the hydrogen supply hole 36; and 70 hydrogen downstream narrow channels (downstream parts) 70 communicating with the hydrogen discharge hole 38. This honeycomb part 52 forms multistage flattened hexagons between the hydrogen upstream narrow channels 68 and the hydrogen downstream narrow channels 70 by having flow channels branching/merging at multiple locations.

The hydrogen upstream narrow channels 68 and the hydrogen downstream narrow channels 70, the numbers of which are 70, have the same shapes and the same positions as parts linearly extending run in the Y-direction portion in the coolant downstream narrow channels 50 (see FIG. 5) and the coolant upstream narrow channels 48. The positions of the hydrogen upstream narrow channels 68 overlap the positions of the hydrogen downstream narrow channels 70 as viewed transparently from the top. The honeycomb part 52 also has the same shape as that provided with the coolant flow channels that is on the upper face side, and overlap those coolant flow channels in a top view without the other components illustrated.

Only the widths of the divergent channels 60 and 62 are different between the honeycomb parts 52 on the upper face of each of the first plates 32 (i.e., coolant flow channels) and on the lower face (i.e., hydrogen flow channels).

Figures 1, 10:
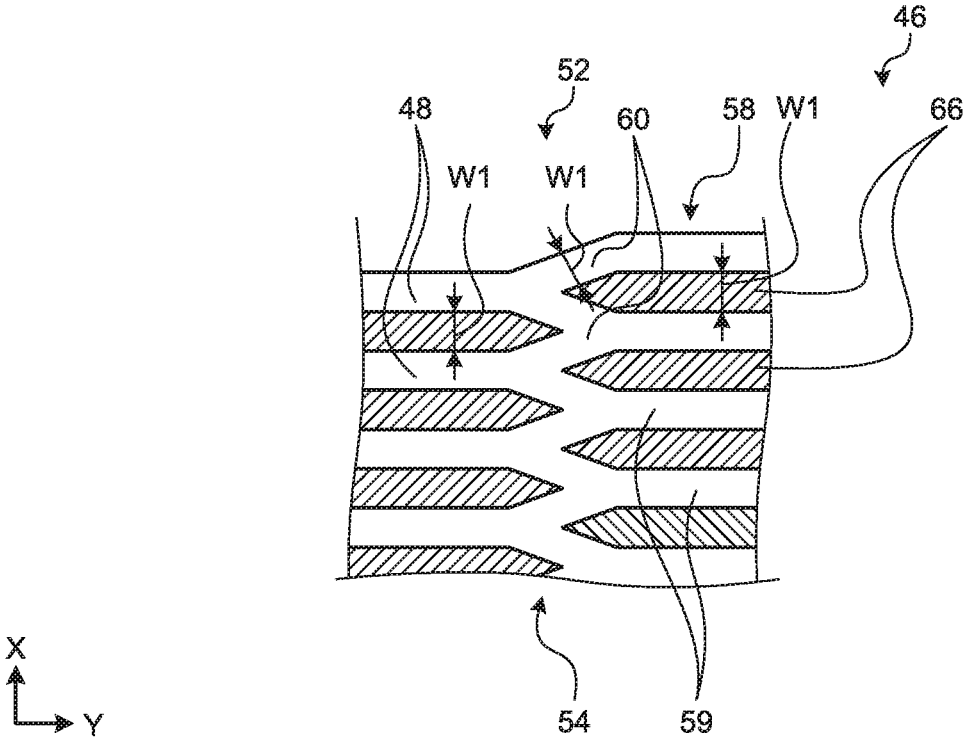
Figures 2, 10:
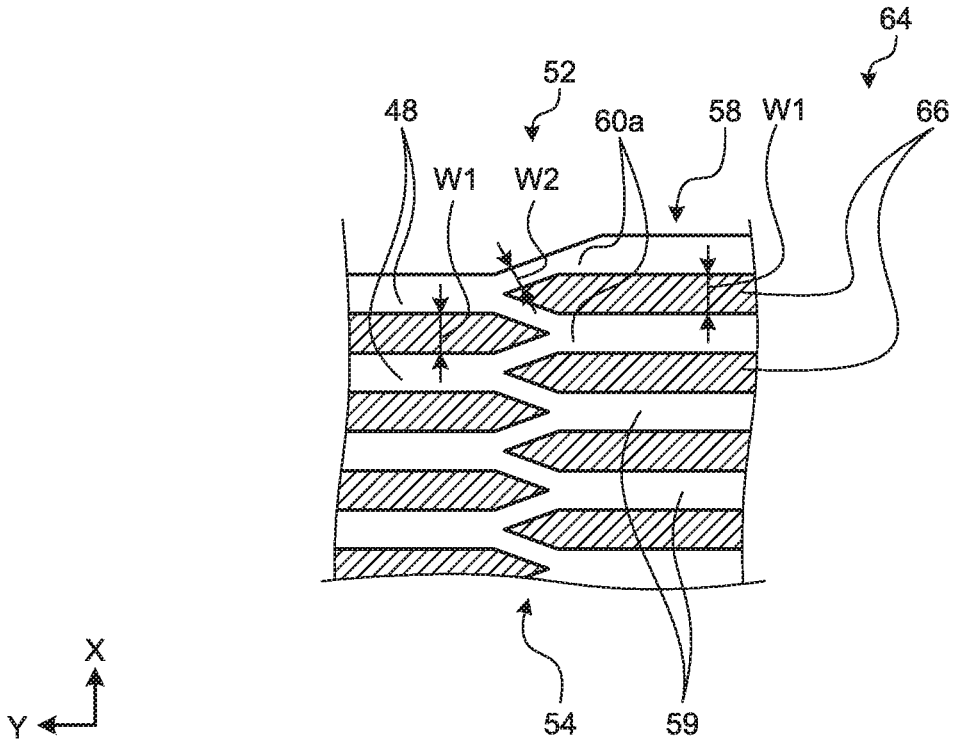

In other words, as illustrated in FIG. 10-1, in the first branching/merging parts 54 on the upper face of the first plate 32, each of the flow channels serving as the coolant upstream narrow channels 48 and the intermediate linear narrow channels 59 and each of the divergent channel 60 have the same width W1. In contrast, as illustrated in FIG. 10-2, on the lower face of the first plate 32, the width of each divergent channel 60*a* is set to W2, which is smaller than W1 while the width of each of the flow channels serving as the hydrogen upstream narrow channels 68 and the intermediate linear narrow channels 59 is W1. For example, W1=0.5 mm, and W2=0.25 mm. The same applies to the divergent channels in the second branching/merging parts 56.

The width W2 of the hydrogen flow channel is set to a relatively small value so that heat exchange performance and pressure resistance can be secured. In the heat exchanger 10, the flow channels desirably have narrow diameters so that the surface area per unit cubic volume can be increased for higher heat exchange efficiency. Considering that narrowing the diameters of the flow channels increases pressure loss, it is needed to balance between narrowing the diameters and the level of pressure loss, which applies to all the flow channels including branching paths and the merging part. Gaseous hydrogen has a small pressure loss. The width W2 can be set to a small value 0.25 mm, with which the heat exchange performance and the pressure resistance are higher than when W2 is 0.5 mm. In contrast, narrowing the diameter of the flow channel for coolant in liquid form increases pressure loss, and the width W1 is set to 0.5 mm.

Figure 11:
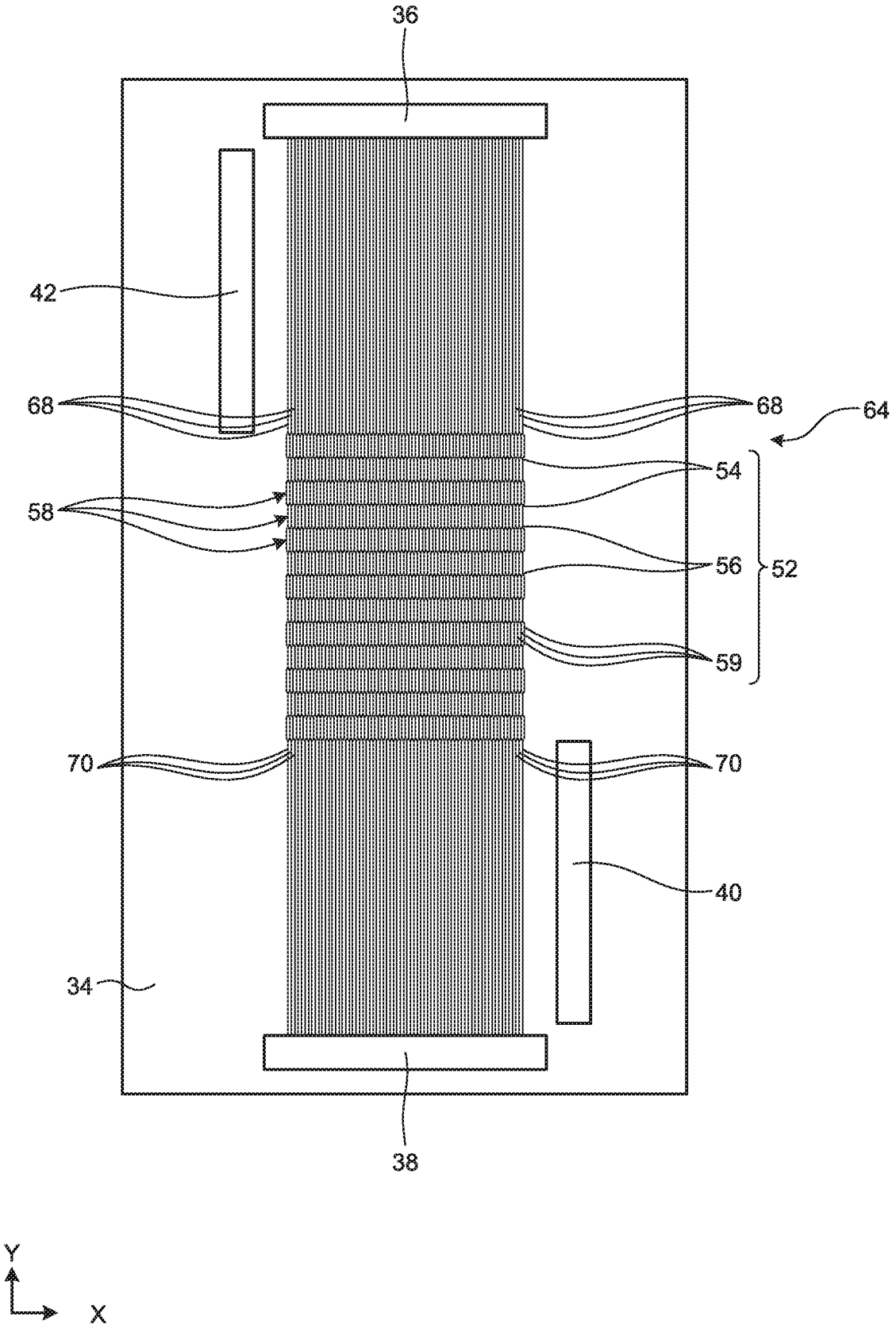
FIG. 11 is a top view of the second plate.

As illustrated in FIG. 11, the lower face of the second plate 34 is mirror-symmetric between the right and left sides to the upper face of the first plate 32 (see FIG. 9) and the upper and lower grooves thereon are laid on each other, thereby forming hydrogen flow channels.

Next, the operation of the heat exchanger 10 thus configured is described. In the heat exchanger 10, the heat exchange efficiency between microchannels in the honeycomb parts 52 and X-direction walls is particularly enhanced.

Each of the coolant flow channels and the hydrogen flow channels formed in large numbers on the faces joined together of the first plates 32 and the second plates 34 is a microchannel having a small cross-sectional area, and temperature deviation across the cross-section thereof is small, which means that heat exchange efficiency is relatively high. In the case of a conventional heat exchanger, however, a mild heat gradient is present within a microchannel, and there is a tendency for efficient heat exchange to be less likely to occur in the center part, which is relatively far from the wall of the flow channel, compared with parts relatively close to the wall of the flow channel. If the flow of fluid is turbulent, stirring of the fluid resolves such a heat gradient but increases a pressure loss. In contrast, in the heat exchanger 10 according to the present embodiment, enhanced heat exchange efficiency is attained with such a heat gradient resolved by provision of the honeycomb part 52 while the feature of pressure loss reduction due to laminar flow is utilized.

Figure 12:
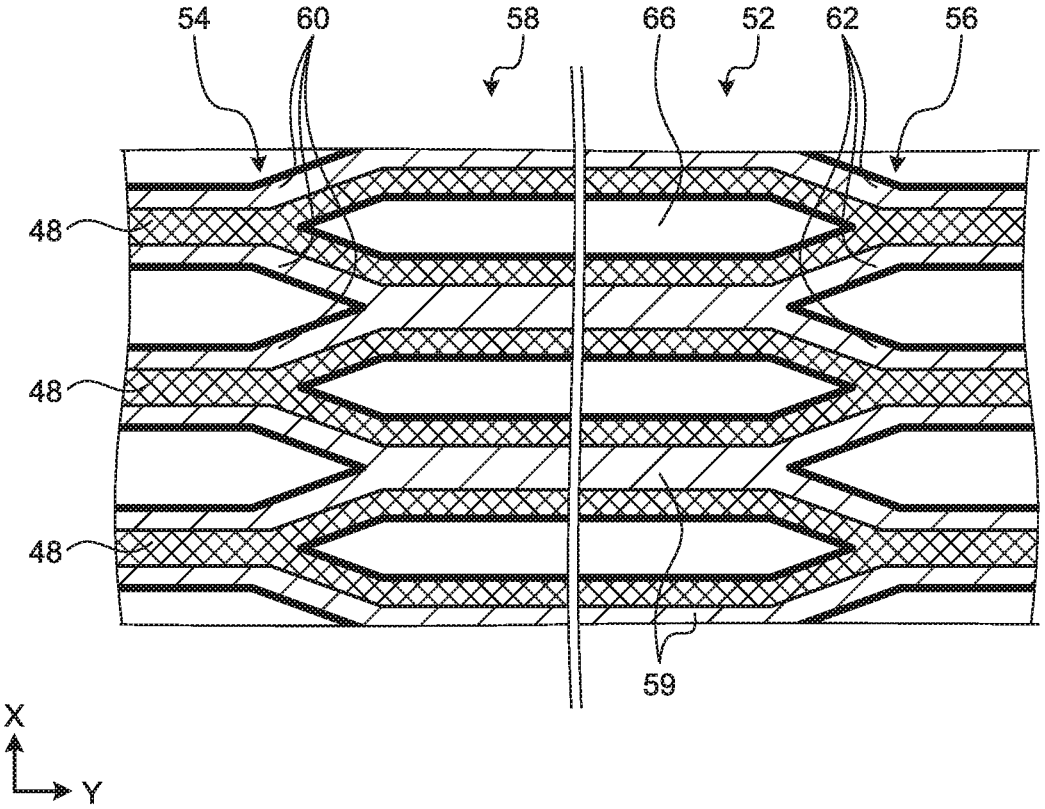
FIG. 12 is a schematic view for explaining the operation of a honeycomb part.

Specifically, as illustrated in FIG. 12, the honeycomb part 52 has the first branching/merging parts 54 and the second branching/merging parts 56 alternately disposed therein, and coolant flowing through the flow channels accordingly branches and merges repeatedly. In this repeated branching and merging, each two adjacent layers among layers (layers schematically indicated by a hatched pattern) making contact with the upper and lower sides of the walls of the flow channels in the X-direction in the left side in FIG. 12 and having relatively large increases in temperature by receiving heat merge in the first branching/merging part 54, thereby forming a central layer and receiving relatively low amounts of heat from the wall of the corresponding flow channel in the intermediate linear narrow channel 59 in the subsequent part. At the same time, each layer (layer schematically indicated by a cross-hatched pattern) flowing in the central part apart from the wall of the corresponding flow channel and having a relatively small increase in temperature by receiving little heat branches in the first branching/merging parts 54 into two channels that are upper and lower in the X-direction, thereby forming layers making contact with the walls of the corresponding flow channels and receiving a relatively high amount of heat from the wall of the corresponding flow channel in the intermediate linear narrow channels 59 in the subsequent part.

Furthermore, in the second branching/merging part 56, each two adjacent layers among layers making contact with the walls of the flow channels and receiving heat until immediately before the entrance therein merge into a layer that flows in the central part in the flow channel in the subsequent part, and each layer flowing in the central part apart from the wall of the corresponding flow channel and receiving little heat until immediately before the entrance therein branches into two channels that make contact with the walls in the flow channels in the subsequent part. While FIG. 12 illustrates the honeycomb part 52 in the coolant flow channels as an example, the same operation applies to the honeycomb part 52 in the hydrogen flow channels except that heat receiving and heat releasing are reversed.

Thus, according to each of the honeycomb parts 52 in the heat exchanger 10, the first branching/merging parts 54 and the second branching/merging parts 56 are alternately provided. As a result, in coolant flowing through the coolant flow channels, the following operation is repeated: while portions flowing near the walls of the flow channels and having relatively large increases in temperature by receiving heat from those walls of the flow channels are guided into the center part, portions flowing in the central parts and having relatively low increases in temperature by receiving little heat from the walls of the flow channels are conversely guided toward the walls of the flow channels. As the same time, in hydrogen flowing through the hydrogen flow channels, the following operation is repeated: while portions flowing near the walls of the flow channels and having relatively large decreases in temperature by releasing heat to those walls of the flow channels are guided into the center part, portions flowing in the central parts and having relatively low decreases in temperature by releasing little heat to the walls of the flow channels are conversely guided toward the walls of the flow channels. This configuration can not only result in increased differences in temperature between fluid and the walls of the flow channels but also suppress deviation in temperature across the cross-section of each of the flow channels, thus enhancing the efficiency of heat releasing and heat receiving. Accordingly, the heat exchanger 10 for obtaining a desired heat exchange capability can be configured with the size and the cost thereof reduced by the degree to which the efficiency is enhanced.

In addition, each of the honeycomb parts 52 has the plurality of first branching/merging parts 54 and the plurality of second branching/merging parts 56 alternately provided therein, the 70 flow channels in the most upstream part are formed into 71 channels in some parts and then 70 channels in the other parts. The number of flow channels thus increases only by one and then decreases only by one a plurality of times, whereby the number of flow channels neither extremely increases nor extremely decreases. This configuration can not only appropriately keep the area of the flow channels within a certain range, thus not being detrimental to the pressure resistance, but also leave little dead space in formation of flow channels, thus enhancing the heat exchange efficiency per unit cubic volume. This feature can be understood also by referring to, for example, FIG. 9, in which only very small wasted regions are left.

The two divergent channels 60, 60 that branch in each of the first branching/merging parts 54 are symmetrical with respect to the direction in which the flow channels run, with the apex of a branching portion being acute-angled, and so are the two divergent channels 62, 62 that branch in each of the second branching/merging parts 56. Accordingly, the two divergent channels 60, 60 and the two divergent channels 62, 62 are allowed to smoothly diverge or merge with laminar flow thereof being maintained. When fluid is thus allowed to flow in the form of laminar flow, the pressure loss is reduced. Particularly in the case of fluid flowing through a large number of microchannels, such effect is high, and motive power for a pump to drive the flow can be reduced.

70 of the coolant upstream narrow channels 48 and 70 of the coolant downstream narrow channels 50 together form a set of the coolant narrow groove clusters 46. Between sets of the coolant narrow groove clusters 46, the coolant supply hole 40 and the coolant discharge hole 42 are provided. This configuration enables coolant to be distributed uniformly among the coolant narrow groove clusters 46 and enables effective use of space between the sets of those clusters. In particular, the coolant supply hole 40 and the coolant discharge hole 42 have elongated-hole shapes flatted in directions in which the flow channels run, whereby the distances in the X-direction between the coolant narrow groove clusters 46.

Each of the honeycomb parts 52 is not limited to a form that has an orderly layout as illustrated in FIG. 5 or FIG. 9 and may be changed to any form that has flow channels branching and merging in multiple stages.

Next, the heat exchanger 10*a* according to a second embodiment is described with reference to FIG. 13 to FIG. 18. The same constituent elements in the heat exchanger 10*a* as those in the heat exchanger 10 are assigned the same reference signs, and detailed description thereof is omitted. The heat exchanger 10*a* includes first flow channels through which first fluid flows, second flow channels through which second fluid flows, and third flow channels through which third fluid flows. The first, the second, and the third flow channels are provided in a stack on top of one another in the Z-direction. The first flow channels include such parts as the coolant upstream narrow channels 48, the coolant downstream narrow channels 50, the honeycomb parts 52, the first branching/merging parts 54, the second branching/merging parts 56, and the linear flow channel parts 58; so do the second flow channels; and so do the third flow channels. The first fluid is hydrogen gas that releases heat, the second fluid is coolant, and the third fluid is heat-releasing fluid that is different from the first fluid.

High-temperature fluid flow channels through which heat-releasing fluid flows and coolant flow channels through which coolant flows are alternately stacked. Specifically, those flow channels are stacked in the following order: the first flow channel (a heat-releasing side), the second flow channel (a heat-receiving side), the third flow channel (a heat-releasing side), the second flow channel (a heat-receiving side), the first flow channel (a heat-releasing side), and so on. This configuration implements efficiently heat exchange because each of the heat-releasing side flow channels is sandwiched between the heat-receiving side flow channels from above and below.

Figure 13:
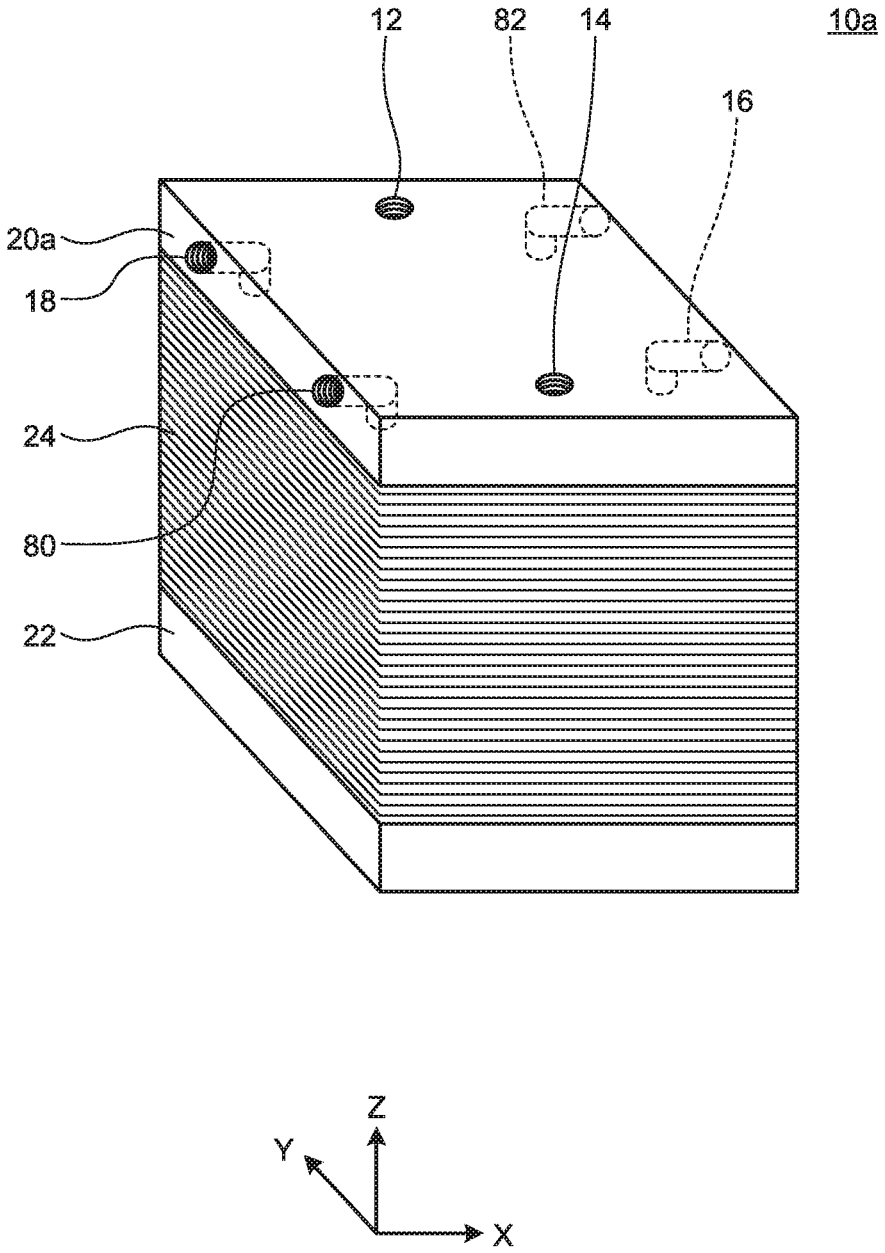
FIG. 13 is a perspective view of a heat exchanger according to a second embodiment.

As illustrated in FIG. 13, the heat exchanger 10*a* has substantially the same shape as the heat exchanger 10. In the uppermost part of the heat exchanger 10*a*, an upper header 20*a* corresponding to the upper header 20 described above is provided. In the upper header 20*a*, a high-temperature fluid inlet 80 is provided on the left face in the near side in the Y-direction, and a high-temperature fluid outlet 82 is provided in the far side in the Y-direction, in addition to the hydrogen inlet 12, the hydrogen outlet 14, the coolant inlet 16, and the coolant outlet 18, to which respective connectors can be attached. High-temperature fluid flow channels (the third flow channels) are formed between the high-temperature fluid inlet 80 and the high-temperature fluid outlet 82, and heat exchange is implemented between coolant and high-temperature fluid (the third fluid). This high-temperature fluid is heat-releasing side fluid that is different from hydrogen gas flowing in the first flow channels (for example, hydrogen gas that has a pressure different from that the first fluid has) and that has a higher temperature than coolant flowing in the second flow channels.

Figure 14:
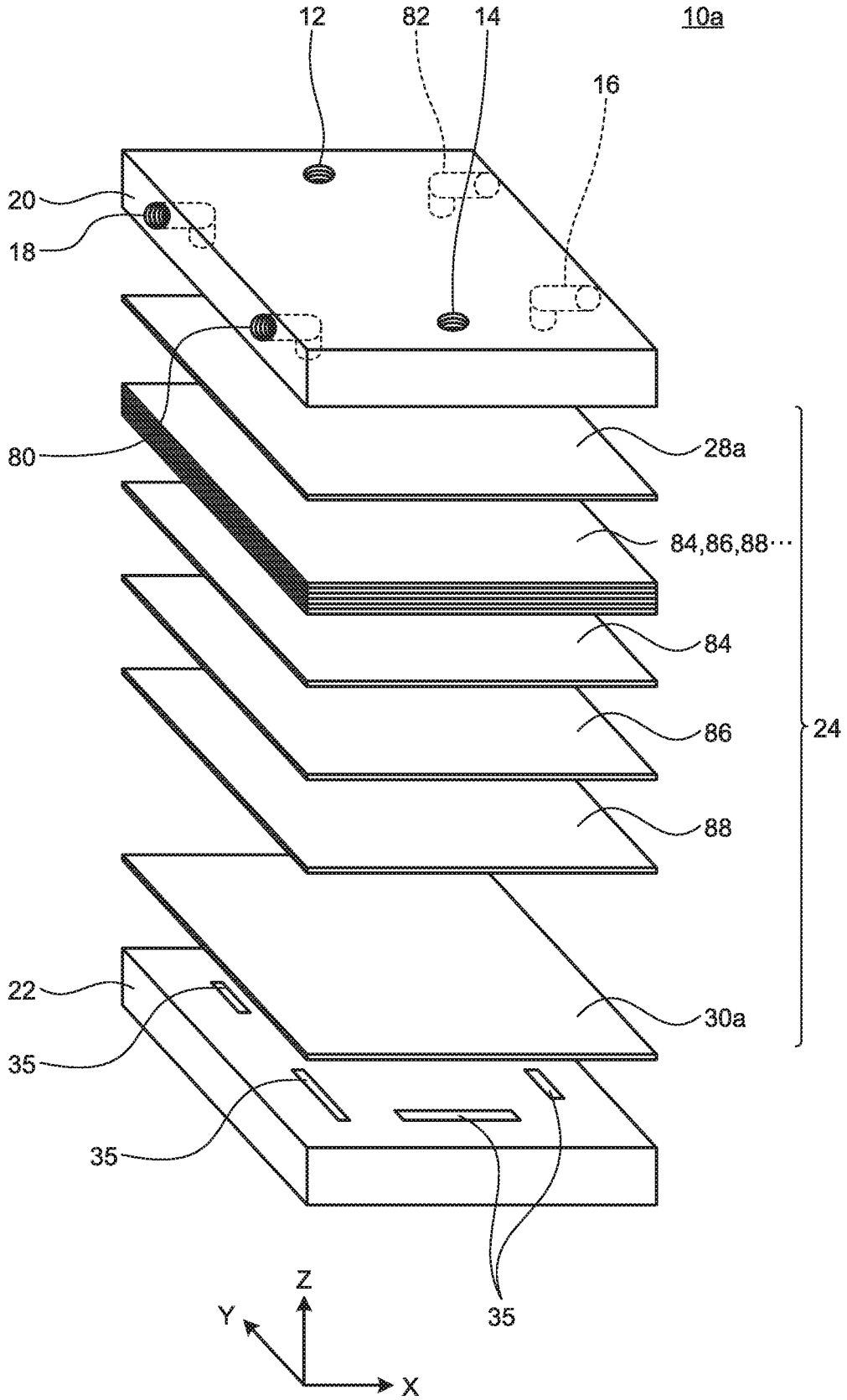
FIG. 14 is an exploded perspective view of the heat exchanger according to the second embodiment.

As illustrated in FIG. 14, the plate stack part 24 in the heat exchanger 10*a* is composed of plates of five kinds stacked on top of one another in the Z-direction, which is the height direction. Specifically, those plates are: a single upper end plate 28*a* disposed immediately below the upper header 20*a*; a single lower end plate 30*a* disposed immediately above a lower header 22*a*; and a plurality of first plates 84, a plurality of second plates 86, and a plurality of third plates 88 disposed in a certain order and alternately therebetween.

Figure 15:
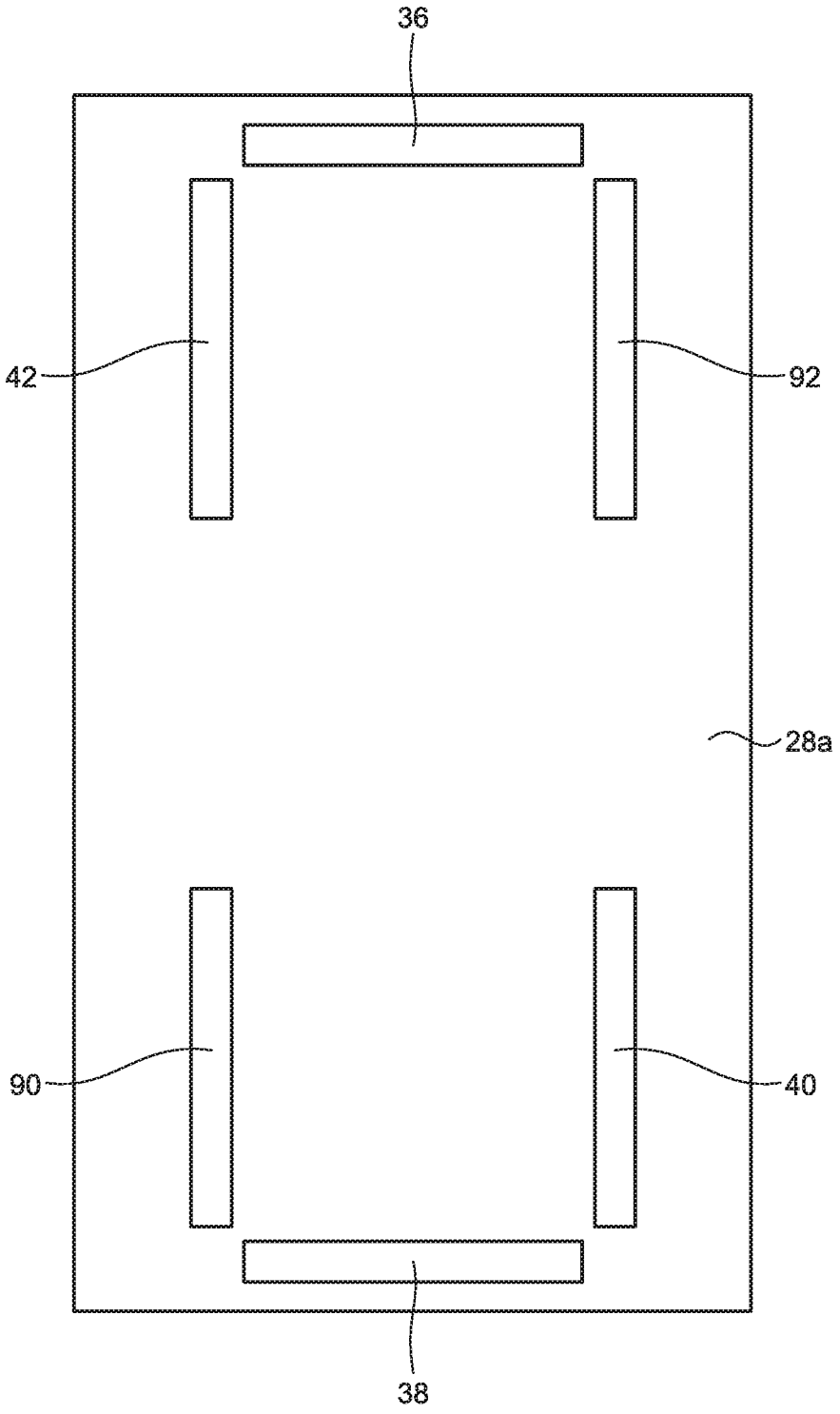
FIG. 15 is a top view of an upper end plate in the second embodiment.
Figure 15:
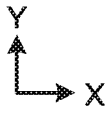

As illustrated in FIG. 15, in the top view, the upper end plate 28*a* includes a high-temperature fluid supply hole 90 and a high-temperature fluid discharge hole 92 in addition to the hydrogen supply hole 36, the hydrogen discharge hole 38, the coolant discharge hole 42, the coolant supply hole 40. The high-temperature fluid supply hole 90 extends in the Y-direction in the neighborhood of an edge of the upper end plate 28*a* in the lower left part of the page. The high-temperature fluid discharge hole 92 extends in the Y-direction in the neighborhood of an edge thereof in the upper right side of the page.

In other words, the upper end plate 28*a* has a shape obtained by adding the high-temperature fluid supply hole 90 and the high-temperature fluid discharge hole 92 to the shape of the upper end plate 28. Those holes in the heat exchanger 10*a* are referred to as penetrating elements. Holes provided as the penetrating elements are all shaped in elongated rectangles and are provided in the upper end plate 28*a*, the first plates 84, the second plates 86, the third plates 88, and the lower end plate 30*a* and penetrate the plate stack part 24. Grooves 35 are provided on the upper face of the lower header 22*a* in positions corresponding to those holes. The lower face of the lower end plate 30*a* is mirror-symmetric between the right and left sides to and has the same shape as the upper face of the upper end plate 28*a*, and illustration and description thereof are therefore omitted.

Figure 16:
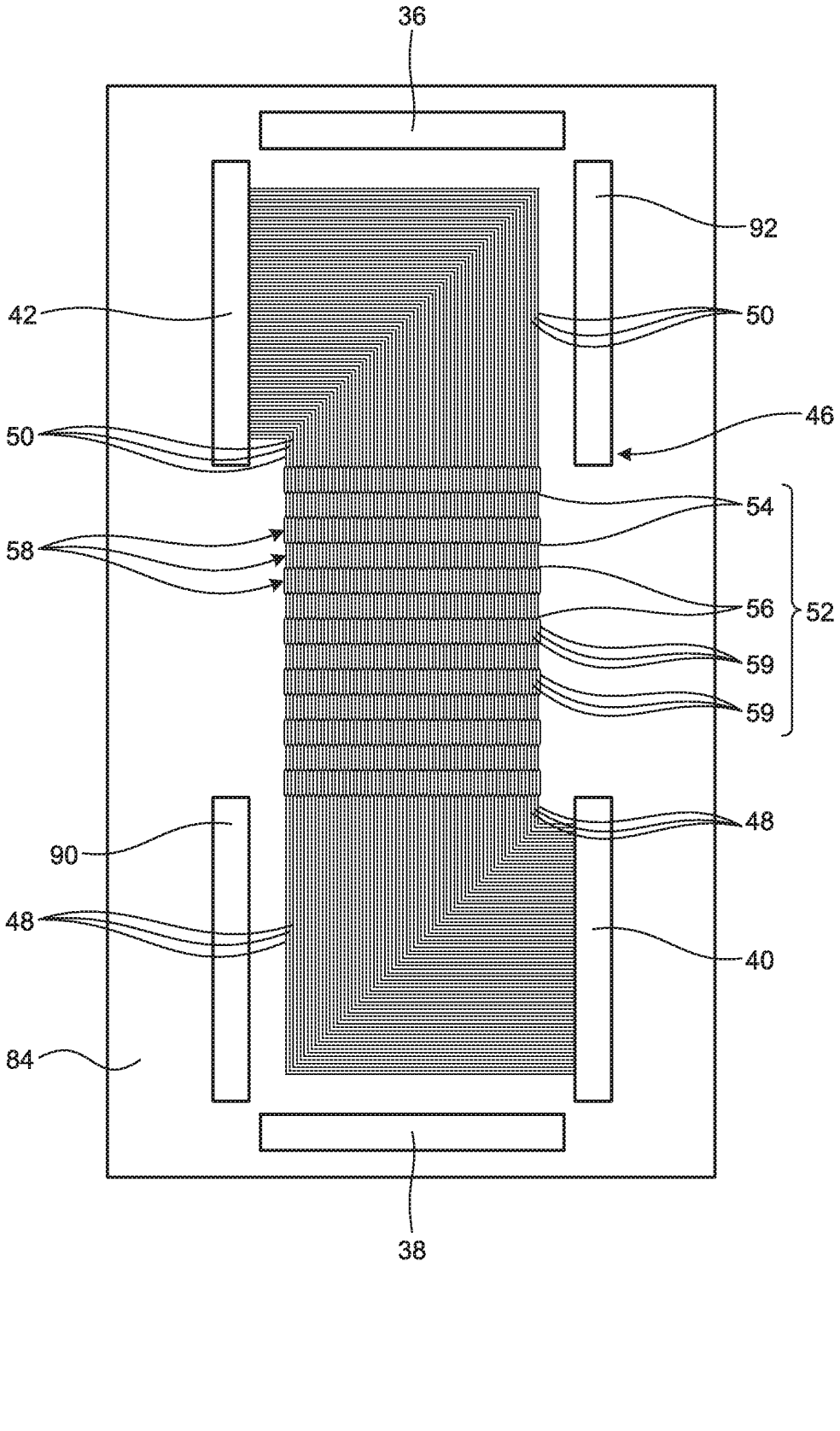
FIG. 16 is a top view of a first plate in the second embodiment.

As illustrated in FIG. 16, the upper face of the first plate 84 has a shape obtained by adding the high-temperature fluid supply hole 90 and the high-temperature fluid discharge hole 92 to the shape of the upper face (see FIG. 5) of the first plate 32 described above. The lower face of the third plate 88 is mirror-symmetric between the right and left sides to the upper face of the first plate 84, and illustration and description thereof are therefore omitted.

Figure 17:
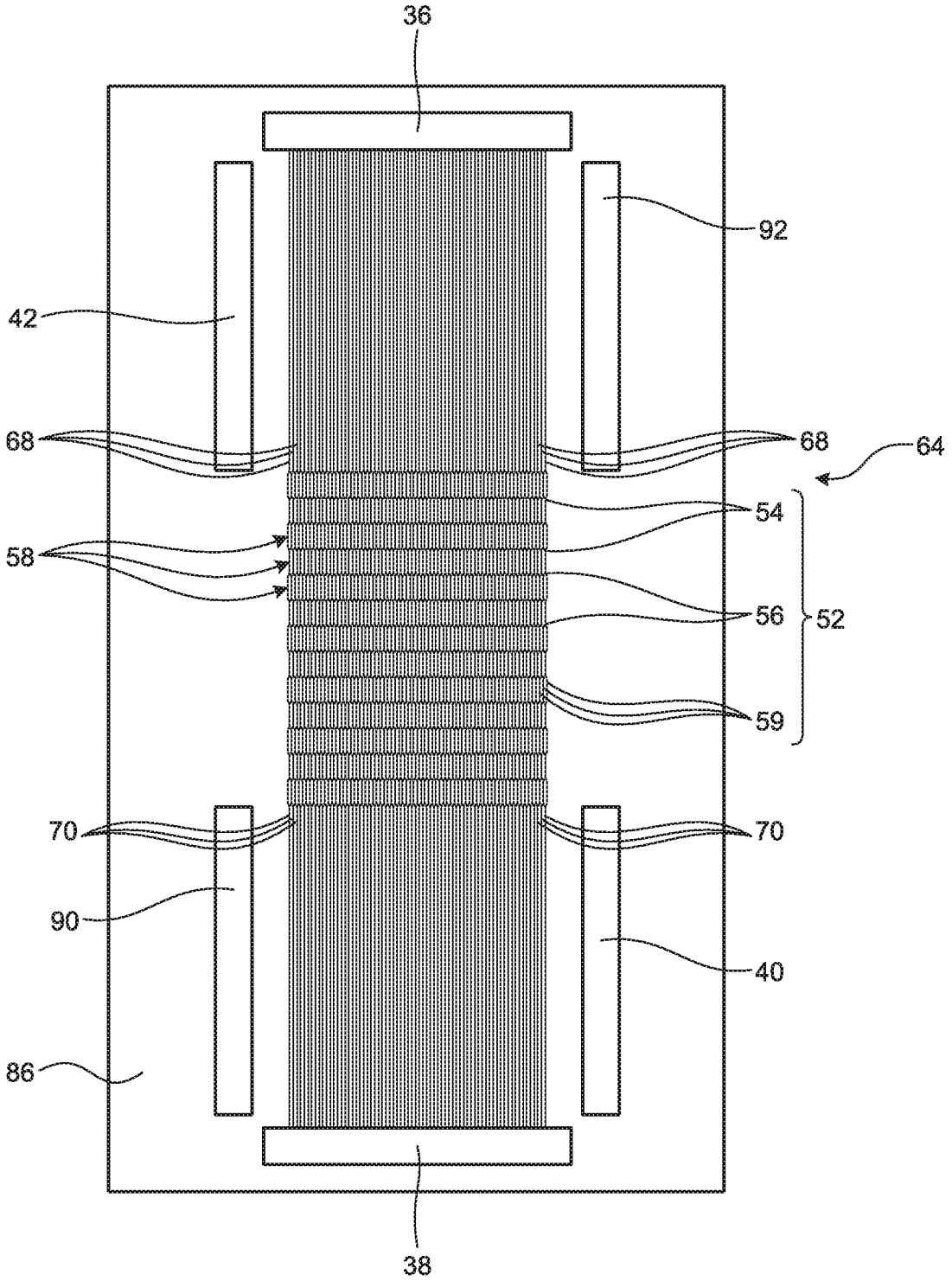
FIG. 17 is a top view of a second plate in the second embodiment.
Figure 17:
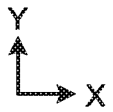

As illustrated in FIG. 17, the upper face of the second plate 86 has a shape obtained by adding the high-temperature fluid supply hole 90 and the high-temperature fluid discharge hole 92 to the shape of the upper face (see FIG. 11) of the second plate 34 described above. The lower face of the first plate 84 is mirror-symmetric between the right and left sides to and has the same shape as the upper face of the second plate 86, and illustration and description thereof are therefore omitted.

Figure 18:
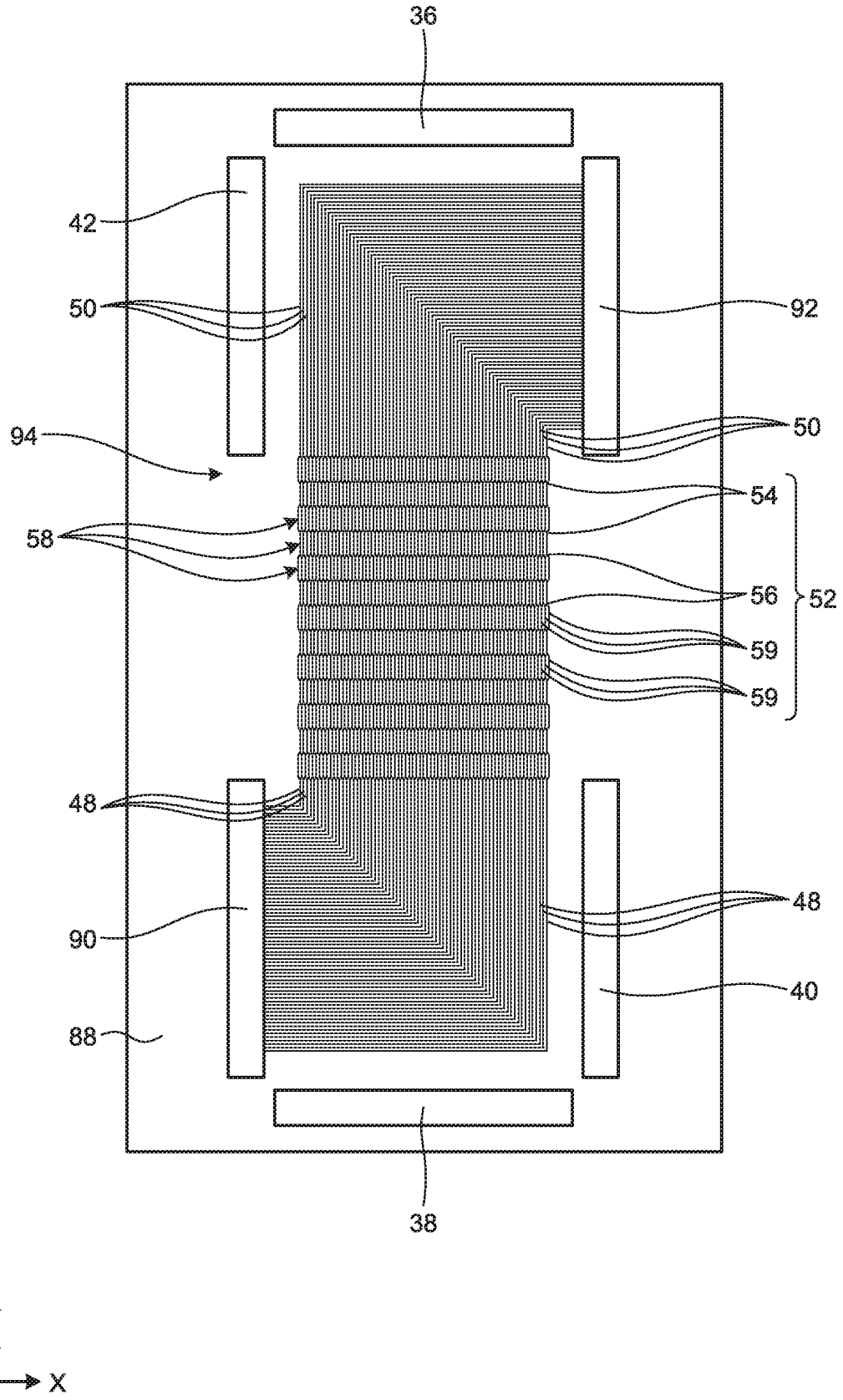
FIG. 18 is a top view of a third plate in the second embodiment.

As illustrated in FIG. 18, a narrow groove cluster 94 that connects the high-temperature fluid supply hole 90 and the high-temperature fluid discharge hole 92 to each other for communication therebetween is provided on the upper face of the third plate 88. The narrow groove cluster 94 is mirror-symmetric between the right and left sides to the coolant narrow groove cluster 46, and high-temperature fluid flows from the high-temperature fluid supply hole 90, then through the narrow groove cluster 94, and then to the high-temperature fluid discharge hole 92. The lower face of the second plate 86 is mirror-symmetric between the right and left sides to the upper face of the third plate 88, and illustration and description thereof are therefore omitted.

In the plate stack part 24 thus configured, each of the first flow channels through which hydrogen flows is formed between the lower face of one of the first plates 84 and the upper face of the second plate 86 that is adjacent to that first plate 84. One of the second flow channels through which coolant flows is formed between the lower face of the upper end plate 28*a* and the upper face of the first plate 84 and the other second flow channel is formed between the lower face of the third plate 88 and the lower end plate 30*a*. Each of the third flow channels through which high-temperature fluid flows is formed between the lower face of one of the second plates 86 and the upper face of the third plate 88 that is adjacent to that first plate 84.

This configuration has the heat-releasing side flow channels and the heat-receiving side flow channels alternately stacked as described above and thereby implements efficient heat exchange. However, it is not necessarily needed to have the heat-releasing side flow channels and heat-receiving side flow channels alternately stacked. The first fluid, the second fluid, and the third fluid to be used in the heat exchanger 10*a* may be a combination of two kinds of coolant and one kind of high-temperature fluid.

While the heat exchanger 10*a* has the first flow channels, the second flow channels, and the third flow channels for three kinds of fluid stacked therein, the heat exchanger 10*a* may have flow channels for four or more kinds of fluid with supply holes and discharge holes for those kinds of fluid appropriately distributed and disposed. In this case, it is preferable that heat-releasing side flow channels and heat-receiving side flow channels be alternately stacked. However, an embodiment is not necessarily needed to be limited to such a configuration and may have, for example, stacking in the following order depending on design-related conditions and properties of the respective kinds of fluid.

Specifically, a first example may be adopted in which flow channels are stacked in the following order: a coolant flow channel, a first high-temperature flow channel, a coolant flow channel, a second high-temperature flow channel, a second high-temperature flow channel, a coolant flow channel, a first high-temperature flow channel, a coolant flow channel, a second high-temperature flow channel, a second high-temperature flow channel, a coolant flow channel, and so on. Alternatively, a second example may be adopted in which flow channels are stacked in the following order: a coolant flow channel, a first high-temperature flow channel, a second high-temperature flow channel, a first high-temperature flow channel, a coolant flow channel, a first high-temperature flow channel, a second high-temperature flow channel, a first high-temperature flow channel, a coolant flow channel, and so on. Further alternatively, a third example may be adopted in which a first coolant flow channel, a first high-temperature flow channel, a first coolant flow channel, a second coolant flow channel, a second high-temperature flow channel, a second coolant flow channel, a first coolant flow channel, a first high-temperature flow channel, a first coolant flow channel, and so on.

In the above description, the terms such as right, left, upper, lower, upper end, lower end, upper face, and lower face are used for the sake of convenience in terms of identification of directions, and the orientation that the heat exchanger 10 when it is installed is not limited to the orientation described above using these terms. The heat exchangers 10 and 10*a* are described above as being intended to be used for hydrogen supply at hydrogen supply stations. However, the intended use of the heat exchangers 10 and 10*a* is not limited thereto, and kinds of fluid that is caused to flow therein are not limited to gaseous hydrogen and liquid coolant.

The present invention is not limited by the above embodiments and, needless to say, can be changed as desired without departing from the spirit of the present invention.

REFERENCE SIGNS LIST

10, 10*a* HEAT EXCHANGER
12 HYDROGEN INLET
14 HYDROGEN OUTLET
16 COOLANT INLET
18 COOLANT OUTLET
20, 20*a* UPPER HEADER
22, 22*a* LOWER HEADER
24 PLATE STACK PART
28, 28*a* UPPER END PLATE
30, 30*a* LOWER END PLATE
32, 84 FIRST PLATE
34, 86 SECOND PLATE
36 HYDROGEN SUPPLY HOLE
38 HYDROGEN DISCHARGE HOLE
40 COOLANT SUPPLY HOLE
42 COOLANT DISCHARGE HOLE
46 COOLANT NARROW GROOVE CLUSTER
48 COOLANT UPSTREAM NARROW CHANNEL (UPSTREAM PART)
50 COOLANT DOWNSTREAM NARROW CHANNEL (DOWNSTREAM PART)
52 HONEYCOMB PART
54 FIRST BRANCH MERGING PART
56 SECOND BRANCH MERGING PART
58 LINEAR FLOW CHANNEL PART
59 INTERMEDIATE LINEAR NARROW CHANNEL
60, 60*a*, 62 COOLANT DIVERSION CHANNEL
64 HYDROGEN NARROW GROOVE CLUSTER
66 ISLAND PART
68 HYDROGEN UPSTREAM NARROW CHANNEL (UPSTREAM PART)
70 HYDROGEN DOWNSTREAM NARROW CHANNEL (DOWNSTREAM PART)
88 THIRD PLATE
94 NARROW GROOVE CLUSTER

The invention claimed is:

1. A heat exchanger comprising:

a plurality of flow channels, wherein the heat exchanger is configured to exchange heat between fluid flowing through the plurality of flow channels, the plurality of flow channels include:

a first flow channel through which first fluid flows; and a second flow channel through which second fluid having a temperature different from a temperature of the first fluid flows, the first flow channel and the second flow channel are provided in such a manner as to be alternately stacked in a stacking direction perpendicular to a direction in which the flow channels extend, each of the first flow channel and the second flow channel includes:

upstream parts disposed parallel to one another in a direction perpendicular to the stacking direction and to a direction in which the flow channels extend;

downstream parts disposed parallel to one another in a direction perpendicular to the stacking direction and to a direction in which the flow channels extend;

branching parts configured to branch the flow channels immediately upstream of the branching parts into two divergent channels; and merging parts configured to merge divergent channels adjacent to one another to form next flow channels, between the upstream parts and the downstream parts, wherein the branching parts and merging parts are provided in a plurality of stages between the upstream parts and the downstream parts, the second fluid is coolant having a lower temperature than the first fluid, the first fluid is fluid having a higher temperature than the second fluid, and the divergent channels in the first flow channels are formed more narrowly than the divergent channels in the second flow channels, wherein the next flow channels between the upstream parts and the downstream parts are linear flow channels, the linear flow channels being provided between an upstream merging part and a downstream branching part in the direction in which the flow channels extend, wherein the linear flow channels are parallel to the direction in which the flow channels extend, and wherein a width of the linear flow channels of the first flow channels and a width of the linear flow channels of the second flow channels are the same.

2. The heat exchanger according to claim 1, wherein the branching parts and merging parts include:

first branching parts configured to branch N number of flow channels immediately upstream of the branching parts into the two divergent channels for each N number of flow channels, and first merging parts configured to respectively merge the divergent channels adjacent to one another by excluding the two outermost divergent channels, to form a next N+1 number of flow channels, and second branching parts configured to branch N−1 number of flow channels, out of the N+1 number of flow channels by excluding the two outermost flow channels, immediately upstream of the second branching parts, into the two divergent channels for each N−1 number of flow channels and second merging parts configured to merge the divergent channels adjacent to one another including the two outermost flow channels to form next N number of flow channels, and the first branching parts and the first merging parts and the second branching parts and the second merging parts are alternately provided in a plurality of stages between the upstream parts and the downstream parts.

3. The heat exchanger according to claim 1, wherein the two divergent channels being configured to branch in the branching parts or merge in the merging parts are symmetric with respect to a direction in which the flow channels extend, with apexes of branching having an angle of 180 degrees or less.

4. The heat exchanger according to claim 1, wherein first plates and second plates are stacked on one another in a part in which heat is exchanged, the first flow channels are formed as grooves between front faces of the first plates and back faces of the second plates, the second flow channels are formed as grooves between front faces of the second plates and back faces of the first plates, and the first plates and the second plates are bonded to each other by diffusion bonding.

5. The heat exchanger according to claim 1, wherein the second fluid is coolant having a lower temperature than the first fluid, and the first fluid is hydrogen gas having a higher temperature than the second fluid.

6. The heat exchanger according to claim 1, wherein the plurality of flow channels include three or more kinds of flow channels including the first flow channel and the second flow channel, and each of the flow channels are provided in such a manner so as to be stacked in the stacking direction, and each of the flow channels includes an upstream part, a downstream part, a branching part and a merging part.

7. The heat exchanger according to claim 1, wherein the two divergent channels that are configured to branch in the branching parts or merge in the merging parts are symmetric with respect to a direction in which the flow channels extend, with apexes of branching having an acute angle.

8. The heat exchanger according to claim 7, wherein the branching parts and merging parts include:

first branching parts configured to branch N number of flow channels immediately upstream of the branching parts into the two divergent channels, and first merging parts configured to merge the divergent channels adjacent to one another excluding the two outermost divergent channels to form next N+1 number of flow channels, and second branching parts configured to branch N−1 number of flow channels, out of the N+1 number of flow channels excluding the two outermost flow channels, immediately upstream of the second branching parts, into the two divergent channels, and second merging parts configured to merge the divergent channels adjacent to one another including the two outermost flow channels to form next N number of flow channels, and the first branching parts and first merging parts and the second branching parts and second merging parts are alternately provided in a plurality of stages between the upstream parts and the downstream parts.

9. The heat exchanger according to claim 7, wherein first plates and second plates are stacked on one another in a part in which heat is exchanged, the first flow channels are formed as grooves between front faces of the first plates and back faces of the second plates, the second flow channels are formed as grooves between front faces of the second plates and back faces of the first plates, and the first plates and the second plates are bonded to each other by diffusion bonding.

10. The heat exchanger according to claim 7, wherein the second fluid is coolant having a lower temperature than the first fluid, and the first fluid is hydrogen gas having a higher temperature than the second fluid.

11. The heat exchanger according to claim 7, wherein the plurality of flow channels include three or more kinds of flow channels including the first flow channel and the second flow channel, and each of the flow channels are provided in such a manner so as to be stacked in the stacking direction, and each of the flow channels includes the upstream part, the downstream part, and the branching/merging part.

* * * * *